US011090653B2

(12) United States Patent
Lee et al.

(10) Patent No.: US 11,090,653 B2
(45) Date of Patent: Aug. 17, 2021

(54) SYSTEMS AND METHODS TO ENCAPSULATE AND PRESERVE ORGANIC MATTER FOR ANALYSIS

(71) Applicants: THE REGENTS OF THE UNIVERSITY OF CALIFORNIA, Oakland, CA (US); PIONEER HI-BRED INTERNATIONAL, INC., Johnston, IA (US)

(72) Inventors: Abraham P. Lee, Irvine, CA (US); Dohyun Lee, Irvine, CA (US); Yue Yun, Johnston, IA (US)

(73) Assignees: THE REGENTS OF THE UNIVERSITY OF CALIFORNIA, Oakland, CA (US); PIONEER HI-BRED INTERNATIONAL, INC., Johnston, IA (US)

( * ) Notice: Subject to any disclaimer, the term of this patent is extended or adjusted under 35 U.S.C. 154(b) by 314 days.

(21) Appl. No.: 16/341,376

(22) PCT Filed: Oct. 10, 2017

(86) PCT No.: PCT/US2017/055984
§ 371 (c)(1),
(2) Date: Apr. 11, 2019

(87) PCT Pub. No.: WO2018/071448
PCT Pub. Date: Apr. 19, 2018

(65) Prior Publication Data

US 2020/0055052 A1 Feb. 20, 2020

Related U.S. Application Data

(60) Provisional application No. 62/406,751, filed on Oct. 11, 2016.

(51) Int. Cl.
*B01L 3/00* (2006.01)

(52) U.S. Cl.
CPC . *B01L 3/502761* (2013.01); *B01L 2200/0668* (2013.01); *B01L 2300/0681* (2013.01);
(Continued)

(58) Field of Classification Search
CPC ..... B01L 2200/0668; B01L 2300/0681; B01L 2300/0867; B01L 2300/0883;
(Continued)

(56) References Cited

U.S. PATENT DOCUMENTS 2,656,508 A 10/1953 Coulter
3,380,584 A 4/1968 Fulwyler
(Continued)

FOREIGN PATENT DOCUMENTS

GB 2395196 5/2004
WO WO2007120240 A2 10/2007
(Continued)

OTHER PUBLICATIONS

International Search Report for PCT Application No. PCT/US18/56852 dated Jan. 11, 2019.
(Continued)

*Primary Examiner* — Jennifer Wecker
*Assistant Examiner* — Jonathan Bortoli
(74) *Attorney, Agent, or Firm* — Nguyen Tarbet LLC

(57) ABSTRACT

Microfluidic systems and methods to generate and analyze microcapsules comprising biological sample, such as for example, single cells, cellular contents, microspore, protoplast, are disclosed. The microcapsules comprising the biological sample can be preserved by a polymerization process that forms a hydrogel around the biological sample. The hydrogel microcapsules can be trapped in a trapping array or collected in an output reservoir and subject to one or more
(Continued)

assays. The trapping array or the output reservoir can be disposed over a porous layer that can filter the continuous phase (e.g., oil) in which the microcapsules are dispersed in the microfluidic device. The pores of the porous layer are configured to be smaller than the size of the microcapsules to prevent the flow of the microcapsules through the porous layer.

20 Claims, 12 Drawing Sheets

(52) U.S. Cl.
CPC ... *B01L 2300/0867* (2013.01); *B01L 2300/12* (2013.01); *B01L 2300/126* (2013.01)

(58) Field of Classification Search
CPC ..... B01L 2300/0887; B01L 2300/12; B01L 2300/123; B01L 2300/126; B01L 2300/161; B01L 2400/0487; B01L 3/502761; B01L 3/502784
See application file for complete search history.

(56) References Cited

U.S. PATENT DOCUMENTS

| | | | | |
|---|---|---|---|---|
| 4,009,435 | A | 2/1977 | Hogg | |
| 5,465,582 | A | 11/1995 | Bliss et al. | |
| 8,263,023 | B2 | 9/2012 | Le Vot et al. | |
| 8,365,311 | B2 | 1/2013 | Nawarathna | |
| 8,927,040 | B2 | 1/2015 | Brand et al. | |
| 9,176,504 | B2 | 11/2015 | Chiou et al. | |
| 2002/0182654 | A1 | 12/2002 | Jing et al. | |
| 2004/0234588 | A1 | 11/2004 | Lu et al. | |
| 2005/0015001 | A1 | 1/2005 | Lec et al. | |
| 2005/0106064 | A1 | 5/2005 | Laurell et al. | |
| 2005/0272039 | A1 | 12/2005 | Yasuda | |
| 2005/0272096 | A1 | 12/2005 | Clague et al. | |
| 2006/0051329 | A1* | 3/2006 | Lee ..... | B01F 5/0646 424/93.7 |
| 2006/0177815 | A1 | 8/2006 | Soh et al. | |
| 2007/0264320 | A1 | 11/2007 | Lee et al. | |
| 2008/0038807 | A1 | 2/2008 | Pommersheim | |
| 2008/0241875 | A1 | 10/2008 | Hwang et al. | |
| 2009/0042310 | A1 | 2/2009 | Ward et al. | |
| 2009/0068170 | A1 | 3/2009 | Weitz et al. | |
| 2009/0075390 | A1 | 3/2009 | Linder et al. | |
| 2009/0286300 | A1 | 11/2009 | Le Vot et al. | |
| 2009/0298191 | A1 | 12/2009 | Whitesides et al. | |
| 2011/0059556 | A1 | 3/2011 | Strey et al. | |
| 2011/0086352 | A1 | 4/2011 | Bashir et al. | |
| 2011/0123398 | A1* | 5/2011 | Carrilho ..... | F16K 99/0015 422/68.1 |
| 2011/1028504 | | 11/2011 | Viovy et al. | |
| 2012/0034155 | A1 | 2/2012 | Hyde et al. | |
| 2012/0107912 | A1 | 5/2012 | Hwang et al. | |
| 2012/0196288 | A1 | 8/2012 | Beer | |
| 2013/0078163 | A1 | 3/2013 | Chung et al. | |
| 2013/0154671 | A1 | 6/2013 | Lee et al. | |
| 2013/0171628 | A1 | 7/2013 | Di Carlo et al. | |
| 2013/0210649 | A1 | 8/2013 | McKnight et al. | |
| 2014/0011291 | A1 | 1/2014 | Patel et al. | |
| 2014/0068797 | A1 | 3/2014 | Doudna et al. | |
| 2014/0076430 | A1 | 3/2014 | Miller et al. | |
| 2015/0018226 | A1 | 1/2015 | Hansen et al. | |
| 2016/0033378 | A1 | 2/2016 | Husain et al. | |
| 2016/0123858 | A1 | 5/2016 | Kapur et al. | |
| 2016/0202153 | A1 | 7/2016 | Gadini et al. | |
| 2017/0014449 | A1 | 1/2017 | Bangera et al. | |
| 2017/0128940 | A1 | 5/2017 | Amini et al. | |
| 2017/0145169 | A1 | 5/2017 | Oakey et al. | |
| 2017/0183722 | A1 | 6/2017 | Link | |
| 2018/0030515 | A1 | 2/2018 | Regev et al. | |
| 2018/0078940 | A1 | 3/2018 | Lee et al. | |

FOREIGN PATENT DOCUMENTS

| | | | |
|---|---|---|---|
| WO | WO2015157567 | A1 | 10/2015 |
| WO | WO2016040476 | A1 | 3/2016 |
| WO | WO2016126871 | A2 | 8/2016 |
| WO | WO2017070169 | A1 | 4/2017 |

OTHER PUBLICATIONS

Lin, R., et al. "High efficiency cell encapsulation utilizing novel on-demand droplet generation scheme and impedance-based detection." 14th international conference on miniaturized systems for chemistry and life sciences, ed. H. Andersson-Svahn, S. Verpoorte, J. Emineus, N. Pam me. 2010.

J. Kim, M. Chung, S. Kim, D. H. Jo, J. H. Kim, and N. L. Jeon, "Engineering of a Biomimetic Pericyte-Covered 3D Microvascular Network," Plos One, vol. 10, p. e0133880, 2015.

X. Wang, D. T. T. Phan, A. Sobrino, S. C. George, C. C. W. Hughes, and A. P. Lee, "Engineering anastomosis between living capillary networks and endothelial cell-lined microfluidic channels," Lab on a Chip, vol. 16, pp. 282-290, 2016.

Mazutis, L. et al., Lab on a Chip, vol. 9, pp. 2665-2672 (2009).

Simon, M.G. et al., Label-Free Detection of DNA Amplification in Dropletsusing Electrical Impedance, 15th International Conference on Miniaturized Systems for Chemistry and Life Sciences 2011 (MicroTAS 2011), pp. 1683-1685 (Year: 2011).

Marsh et al. Room temperature ionic liquids and their mixtures—a review. Fluid Phase Equilibria 219 (2004) 93-98.

Oh, Woon Su, "Synthesis and applications of imidazolium-based ionic liquids and their polymer derivatives" (2012). Doctoral Dissertations. 1958. http://scholarsmine.mst.edu/doctoral_dissertations/1958.

Baret et. al,"Fluorescence-activated droplet sorting (FADS): efficient microfluidic cell sorting based on enzymatic activity," Lab Chip. Jul. 7, 2009; 9(13):1850-8. doi: 10.1039/b902504a. Epub Apr. 23, 2009.

Macosko et al., "Highly Parallel Genome-wide Expression Profiling of Individual Cells Using Nanoliter, Droplets," Cell, vol. 161, No. 5, pp. 1202-1214, May 2015.

International Search Report for PCT Application No. PCT/US18/36962 dated Aug. 30, 2018.

International Search Report for PCT Application No. PCT/US18/36952 dated Sep. 18, 2018.

Inexpensive Droplet-Based Microfluidic Platform. CIDAR lab. https://www.youtube.com/watch?v=aHvfEOlh_b4.

Kamalakshakurup et al. High-efficiency single cell encapsulation and size selective capture of cells in picoliter droplets based on hydrodynamic micro-vortices. Lab Chip, 2017, 17, 4324-4333.

Brouzes, Eric, et al. "Droplet microfluidic technology for single-cell high-throughput screening." Proceedings of the National Academy of Sciences106.34 (2009): 14195-14200.

S. I. Rubinow and J. B. Keller, "The transverse force on a spinning sphere moving in a viscous fluid," J. Fluid Mech., vol. 11, No. 03, p. 447, Nov. 1961.

Murata et al., Electrochemical single-cell gene-expression assay combining dielectrophoretic manipulation with secreted alkaline phosphatase reporter system, 2009, Biosensors and Bioelectronics, 25, 913-919.

Stinson et al., Genes Expressed in the Male Gametophyte of Flowering Plants and Their Isolation, 1987, Plant Physiol., 83, 442-447.

International Search Report for PCT Application No. PCT/US2016/056683 dated Dec. 27, 2016.

International Search Report for PCT Application No. PCT/US18/55722 dated Feb. 6, 2019.

International Search Report for PCT Application No. PCT/US17/55984 dated Dec. 14, 2017.

Doria, Arlene et al., "Rapid blood plasma separation with air-liquid cavity acoustic transducers", 15th International conference on miniaturized systems for chemistry and life sciences, Oct. 2-6, 2011, pp. 1882-1884.

(56) References Cited

OTHER PUBLICATIONS

Lee, Abraham P. et al. , "Microfluidic air-liquid cavity acoustic transducers for on-chip integration of sample preparation and sample detection", Journal of laboratory automation, Dec. 2010, vol. 15, No. 6, pp. 449-454.
International Search Report Issued for PCT Application No. PCT/US2013/042735 dated Nov. 28, 2013.

* cited by examiner

SYSTEMS AND METHODS TO ENCAPSULATE AND PRESERVE ORGANIC MATTER FOR ANALYSIS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTION

Field of the Invention

The systems and methods disclosed herein relate to the use of microfluidic devices that are used in chemical assays of plant cells. The systems and methods disclosed herein can prepare encapsulate a single plant cell in a microcapsule and preserve the encapsulated plant cell. The systems and methods may be used to non-destructively select plant cells with desired genotypes or expression patterns.

Description of the Related Art

The ability to detect the complexity of a biological system at single cell resolution has opened new avenues in research in characterizing cellular heterogeneity, tracing cell lineage, measuring mutation rate, and identifying rare cell types, thereby stimulating the development of technologies that serve single cell manipulation, detection and analysis.

Single cell technologies will provide crucial insights in plant science, such as in the understanding of key events related to plant embryo or microspore development, root and shoot differentiation, and cellular response to pathogen attack. In addition, plants possess unique single cell types, such as microspores, for which the application of single cell technologies would be particularly beneficial.

Microfluidic devices can be used to prepare and manipulate single cells for various assays. For example, microfluidic devices can be configured to encapsulate single cells in discrete droplets. The discrete droplets can be transported to an analysis region wherein the encapsulated single cells can be analyzed. The viability of the encapsulated single cells may time limited.

Droplet based microfluidic devices rely on a continuous phase to generate the droplets and transport the generated droplets through the microfluidic device. Some techniques for analysis of microcapsules are more efficient if the microcapsules can be separated from other matter in the microfluidic devices.

SUMMARY OF THE INVENTION

It is desirable to remove the continuous phase from then analysis region prior to the analysis of the single cells encapsulated in the droplets. It is also desirable to exchange the continuous phase in the analysis region with a buffer solution prior to the analysis of the single cells encapsulated in the droplets. This application contemplates systems and methods that would preserve droplets comprising encapsulated single cells as well as removing the continuous phase from the analysis regions and/or exchanging the continuous phase with a buffer solution.

It would be advantageous if the droplets can be preserved to extend the viability of the droplets more than a few hours or a few days.

In one example, a method is provided for isolating plant cells. The method can employ a microfluidic device. A sample can be flowed (or can flow) into a passage of the microfluidic device. The sample can include at least one of a single cell, maize or corn cells, protoplast, microspore, pollen, polynucleotide including but not limited to genomic DNA, mRNA, or protein, and/or other matter of interest to be studied. The sample can flow a junction. An oil can be flowed (or can flow) into the junction through two oil phase passages to form microcapsules. The microcapsules enclose the at least one of the plant cell or the plant polynucleotide. The microcapsules and a volume of the oil form a microcapsule-oil mixture in a mixture passage. A preservation agent can be flowed (or can flow) into the mixture passage. The preservation agent mixes with the microcapsule-oil mixture to form preserved microcapsules. The preserved microcapsules are extracted from the microfluidic device.

In another embodiment, a method is provided in which a sample (e.g., plant cells and/or DNA) dispersed in a first fluid flow through a microfluidic passage into a junction. The sample dispersed in the first fluid is combined with a second fluid immiscible with the first fluid. Droplets of the first fluid enclosing the sample are formed. The droplets enclosing the sample can be transformed from the liquid phase to a solid or a gel phase using a polymerization process. A mixture including droplets of the sample and the fluid is formed. The polymerized samples dispersed in the second fluid flow over or onto a porous layer (e.g., a filter paper) at or adjacent to an outlet. The porous layer retains the second fluid such that the microcapsules are accumulated in the outlet.

In another embodiment, a microfluidic device is provided that includes an inlet passage for directing a sample that includes at least one solid constituent into the microfluidic device. The microfluidic device includes a fluid supply passage and an outlet. The fluid supply passage is configured to convey a stream of a fluid in fluid communication with the inlet passage. The outlet is in fluid communication with the inlet passage and the fluid supply passage. The microfluidic device includes a porous member at least partially bounding a fluid passage leading to or a portion of the outlet. The microfluidic device is configured to form microcapsules upstream of the porous member. The microcapsules are formed around the at least one solid constituent within the fluid. The porous member is configured to absorb or convey the fluid away from the microcapsules to allow a higher concentration of microcapsules to be accessible at the outlet.

In another embodiment, a microfluidic device is provided. The microfluidic device includes an inlet for directed a fluid sample into the device and an outlet in fluid communication with the inlet. The fluid sample comprises a solid component and a liquid component. The microfluidic device includes a filter disposed adjacent to the outlet. The filter is configured to remove the liquid component of the fluid sample from the device while blocking the solid component from being removed from the outlet. A pore size of the filter is less than the size of the solid component that is blocked. The solid component to be blocked can be a plant cell or plant polynucleotide segment.

BRIEF DESCRIPTION OF THE DRAWINGS

These and other features, aspects and advantages are described below with reference to the drawings, which are intended to illustrate but not to limit the inventions. In the drawings, like reference characters denote corresponding features consistently throughout similar embodiments. The following is a brief description of the drawings.

DETAILED DESCRIPTION OF THE PREFERRED EMBODIMENT

Figure 1A:
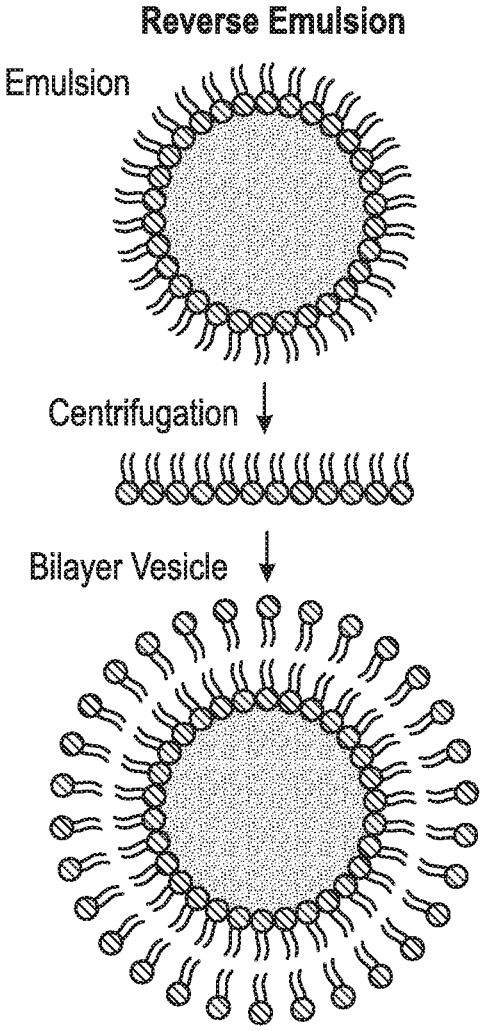
FIGS. 1A, 1B, and IC show three different techniques for forming microcapsules, e.g., lipid vesicles, that can encapsulate solid and dissoluble materials in an internal aqueous phase and be dispersed in the external aqueous phase.

It is to be understood that this invention is not limited to particular embodiments, which can, of course, vary. It is also to be understood that the terminology used herein is for the purpose of describing particular embodiments only, and is not intended to be limiting. Further, all publications referred to herein are each incorporated by reference for the purpose cited to the same extent as if each was specifically and individually indicated to be incorporated by reference herein.

As used in this specification and the appended claims, terms in the singular and the singular forms "a," "an," and "the," for example, include plural referents unless the content clearly dictates otherwise. Thus, for example, reference to "plant," "the plant," or "a plant" also includes a plurality of plants; also, depending on the context, use of the term "plant" can also include genetically similar or identical progeny of that plant; use of the term "a nucleic acid" optionally includes, as a practical matter, many copies of that nucleic acid molecule; similarly, the term "probe" optionally (and typically) encompasses many similar or identical probe molecules.

As used herein, the terms "comprises," "comprising," "includes," "including," "has," "having," "contains", "containing," "characterized by" or any other variation thereof, are intended to cover a non-exclusive inclusion, subject to any limitation explicitly indicated. For example, a composition, mixture, process, method, article, or apparatus that comprises a list of elements is not necessarily limited to only those elements but may include other elements not expressly listed or inherent to such composition, mixture, process, method, article, or apparatus.

The transitional phrase "consisting of" excludes any element, step, or ingredient not specified. In a claim, such would close the claim to the inclusion of materials other than those recited except for impurities ordinarily associated therewith. When the phrase "consisting of" appears in a clause of the body of a claim, rather than immediately following the preamble, it limits only the element set forth in that clause; other elements are not excluded from the claim as a whole. The transitional phrase "consisting essentially of" is used to define a composition, method or apparatus that includes materials, steps, features, components, or elements, in addition to those literally disclosed, provided that these additional materials, steps, features, components, or elements do not materially affect the basic and novel characteristic(s) of the claimed invention.

Certain definitions used in the specification and claims are provided below. In order to provide a clear and consistent understanding of the specification and claims, including the scope to be given such terms, the following definitions are provided:

"Allele" means any of one or more alternative forms of a genetic sequence. In a diploid cell or organism, the two alleles of a given sequence typically occupy corresponding loci on a pair of homologous chromosomes. With regard to a SNP marker, allele refers to the specific nucleotide base present at that SNP locus in that individual plant.

The term "amplifying" in the context of polynucleotide amplification is any process whereby additional copies of a selected polynucleotide (or a transcribed form thereof) are produced. An "amplicon" is an amplified polynucleotide, e.g., a polynucleotide that is produced by amplifying a template polynucleotide by any available amplification method.

"Callus" refers to a dedifferentiated proliferating mass of cells or tissue.

The phrases "contacting", "comes in contact with" or "placed in contact with" can be used to mean "direct contact" or "indirect contact". For example, the medium comprising a doubling agent may have direct contact with the haploid cell or the medium comprising the doubling agent may be separated from the haploid cell by filter paper, plant tissues, or other cells thus the doubling agent is transferred through the filter paper or cells to the haploid cell.

A "diploid" plant has two sets (genomes) of chromosomes and the chromosome number (2n) is equal to that in the zygote.

An "embryo" of a plant is a young and developing plant.

A "genetic map" is a description of genetic association or linkage relationships among loci on one or more chromosomes (or linkage groups) within a given species, generally depicted in a diagrammatic or tabular form.

"Genotype" is a description of the allelic state at one or more loci in a genome.

A "haploid" is a plant with the gametic or n number of chromosomes.

The terms "label" and "detectable label" refer to a molecule capable of detection. A detectable label can also include a combination of a reporter and a quencher, such as are employed in FRET probes or TAQMAN® probes. The term "reporter" refers to a substance or a portion thereof that is capable of exhibiting a detectable signal, which signal can be suppressed by a quencher. The detectable signal of the reporter is, e.g., fluorescence in the detectable range. The term "quencher" refers to a substance or portion thereof that is capable of suppressing, reducing, inhibiting, etc., the detectable signal produced by the reporter. As used herein, the terms "quenching" and "fluorescence energy transfer" refer to the process whereby, when a reporter and a quencher are in close proximity, and the reporter is excited by an energy source, a substantial portion of the energy of the excited state nonradiatively transfers to the quencher where it either dissipates nonradiatively or is emitted at a different emission wavelength than that of the reporter.

A "male gametic cell" as used herein is any male haploid cell involved in the process of microsporogenesis and microgametogenesis. A male gametic cell may comprise but is not limited to a tetrad microspore, a single cell microspore, or a pollen grain. The term "male gametic cell" may also comprise tetrad pollen grains found in the quartet mutants.

"Marker" or "molecular marker" is a term used to denote a polynucleotide or amino acid sequence that is sufficiently unique to characterize a specific locus on the genome. Any detectable polymorphic trait can be used as a marker so long as it is inherited differentially and exhibits linkage disequilibrium with a phenotypic trait of interest.

As used herein, a "marker profile" means a combination of particular alleles present within a particular plant's genome at two or more marker loci which are not linked, for instance two or more loci on two or more different linkage groups or two or more chromosomes. For instance, in one example, one marker locus on chromosome 1 and a marker locus on another chromosome are used to define a marker profile for a particular plant. In certain other examples a plant's marker profile comprises one or more haplotypes. The term "medium" includes compounds in liquid, gas, or solid state.

A "meiotically-related product" is a product of meiosis that occurs as a result of microsporogenesis. The meiotically-related product may be a microspore.

A "microspore" is an individual haploid structure produced from diploid sporogenous cells (microsporoyte, pollen mother cell, or meiocyte) following meiosis.

A "pollen grain" is a mature gametophyte containing vegetative (non-reproductive) cells and a generative (reproductive) cell.

As used herein, the term "plant" includes reference to whole plants, plant organs (e.g., leaves, stems, roots, etc.), seeds and plant cells and progeny of same. "Plant cell", as used herein includes, without limitation, seeds, cells from seeds, suspension cultures, embryos, meristematic regions, callus tissue, leaves, roots, shoots, gametophytes, sporophytes, pollen, and microspores. Protoplasts are also included in the definition of a plant cell for the methods defined herein.

A "protoplast" is the protoplasm of a living plant or bacterial cell whose cell wall has been removed.

A plant cell used in the methods herein may be from any plant including, without limitation, maize, canola, soybean, sorghum, rice, wheat, millet, alfalfa and sunflower. In some embodiments, the plant cell is from a maize plant.

"Polymorphism" means a change or difference between two related polynucleotides. A "nucleotide polymorphism" refers to a nucleotide that is different in one sequence when compared to a related sequence when the two polynucleotides are aligned for maximal correspondence.

"Polynucleotide," "polynucleotide sequence," "polynucleotide sequence," "polynucleotide fragment," and "oligonucleotide" are used interchangeably herein to indicate a polymer of nucleotides that is single- or multi-stranded, that optionally contains synthetic, non-natural, or altered RNA or DNA nucleotide bases. A DNA polynucleotide may be comprised of one or more strands of cDNA, genomic DNA, synthetic DNA, or mixtures thereof.

"Primer" refers to an oligonucleotide which is capable of acting as a point of initiation of polynucleotide synthesis or replication along a complementary strand when placed under conditions in which synthesis of a complementary strand is catalyzed by a polymerase. Typically, primers are about 10 to 30 nucleotides in length, but longer or shorter sequences can be employed. Primers may be provided in double-stranded form, though the single-stranded form is more typically used. A primer can further contain a detectable label, for example a 5' end label.

"Probe" refers to an oligonucleotide that is complementary (though not necessarily fully complementary) to a polynucleotide of interest and forms a duplexed structure by hybridization with at least one strand of the polynucleotide of interest. Typically, probes are oligonucleotides from 10 to 50 nucleotides in length, but longer or shorter sequences can be employed. A probe can further contain a detectable label.

Standard recombinant DNA and molecular cloning techniques used herein are well known in the art and are described more fully in Sambrook et al. Molecular Cloning: A Laboratory Manual; Cold Spring Harbor Laboratory Press: Cold Spring Harbor, 1989 (hereinafter "Sambrook").

This application is directed to apparatuses and methods for encapsulating solid biological matter into microcapsules for analysis. The microcapsules can be generated in any suitable way, such as in microfluidic devices as disclosed herein. The solid biological matter to be encapsulated can include any matter of interest including animal matter, plant matter, non-animal matter, non-plant matter, animal cells, plant cells, non-animal cells, non-plant cells, maize or corn cells, protoplast, microspore, pollen, cellular components including but not limited to DNA, RNA, or protein, and/or other matter of interest to be studied. The apparatuses and methods are also well suited for preserving delicate structures in the microcapsules by preparing preserved microcapsule which can be prepared by exposing microcapsules to a preservation agent. The apparatuses and methods disclosed are well suited for convenient and efficient processing of microcapsules or preserved microcapsules through fluid exchange and/or trapping single microcapsules. Microcapsule processing can include exchanging a first fluid surrounding the microcapsules or preserved microcapsules for a second fluid surrounding the microcapsules or preserved microcapsules. The first fluid can be an oil that can be trapped in a porous structure such as a paper layer as part of this exchange. Microcapsule processing can include trapping microcapsules or preserved microcapsules in trap arrays.

I. Forming Microcapsules

Figure 1B:
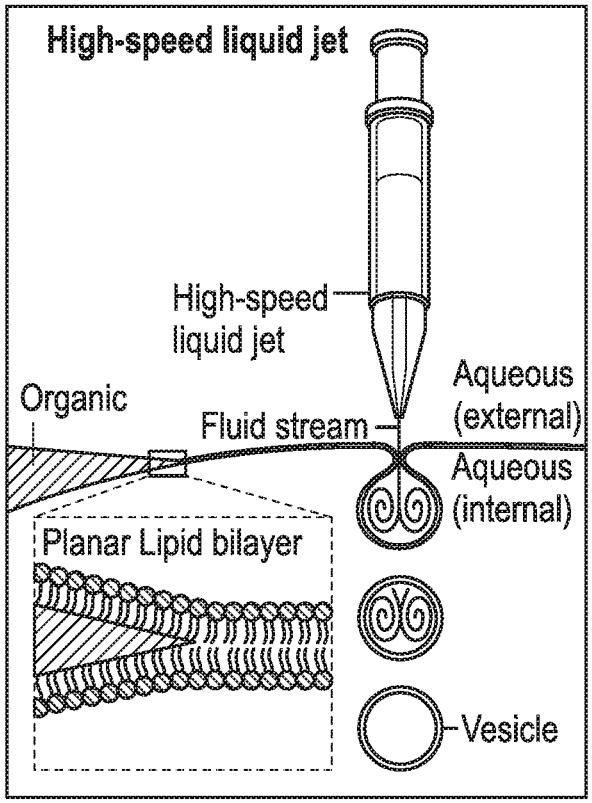
Figure 1C:
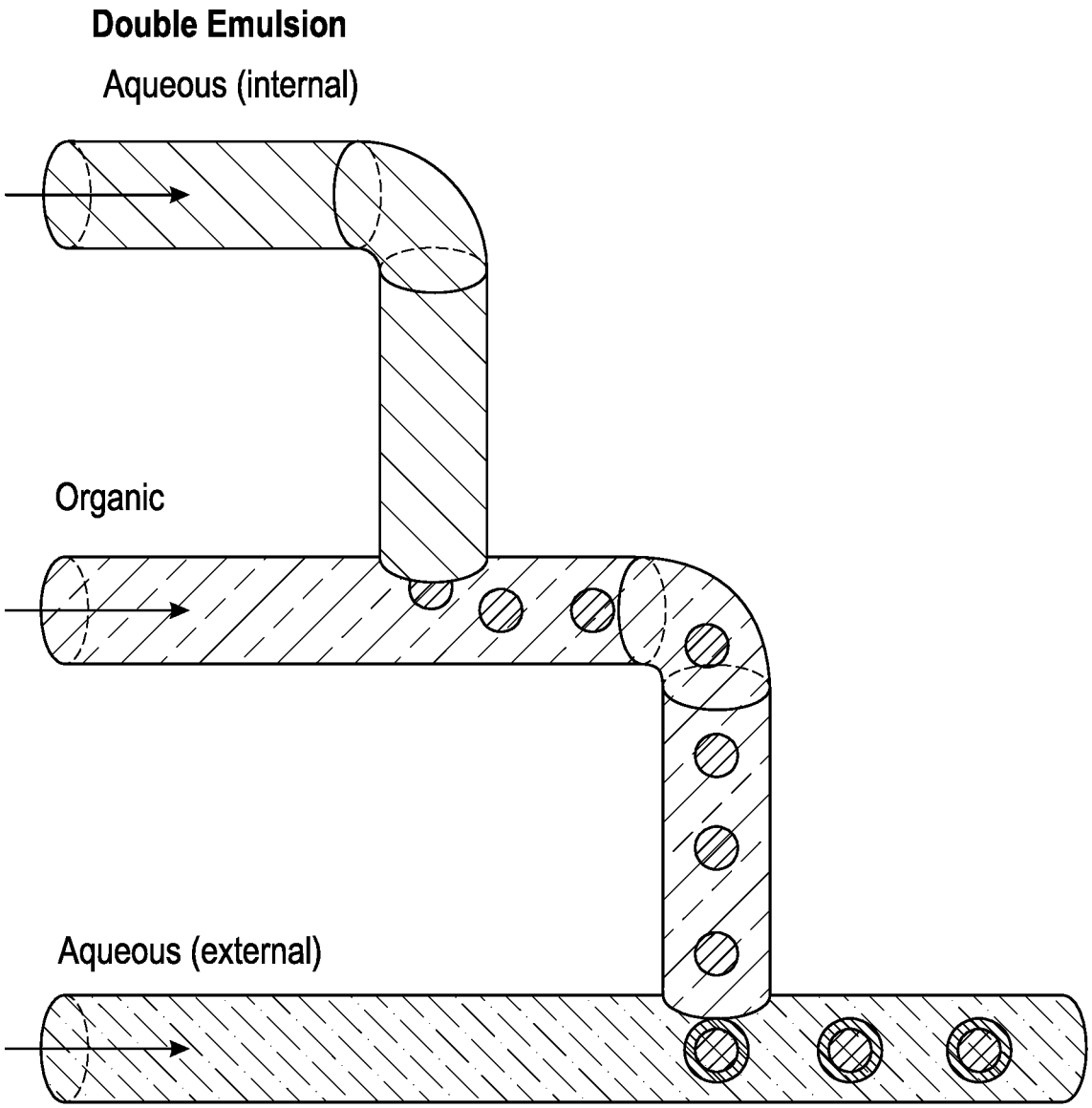

FIGS. 1A-1C illustrate microcapsules, e.g., lipid vesicles, that can encapsulate matter including solids and dissoluble materials into the internal aqueous phase. The microcapsules can be dispersed in an external aqueous phase in these methods. These processes have been applied to cosmetics, foods and drugs. FIG. 1A illustrates a reverse emulsion process to form microcapsules. FIG. 1B illustrates another method that employs a high speed liquid jet to form microcapsules. FIG. 1C illustrates a double emulsion process wherein microcapsules can be formed in small passageways, e.g., in a microfluidic device.

FIG. 1C schematically illustrates a microfluidic platform for double-emulsion microencapsulation of organic matter. The method comprises forming single emulsion droplets of an internal phase (e.g., aqueous phase) at a first T-junction. Then droplets of the internal phase encapsulated within the organic matter were generated via another emulsion process at a second T-junction.

A. Microfluidic Devices for Generating and Processing Microcapsules Enclosing Samples In some embodiments novel microfluidic devices are configured to form microcapsules, and also to modify the microcapsules so that preserved microcapsules are formed. Preserved microcapsules have greater longevity so that analysis can be more conveniently performed. Some novel microfluidic devices herein have a porous structure such as a paper layer. This structure enables oil to be impregnated into pores, e.g., in the paper layer, and thus to be separated from the microcapsules, e.g., the lipid vesicles. This allows the microcapsules, e.g., lipid vesicles, to be re-suspended in an aqueous phase separate from the oil phase. In one example, an oil-suspended monodisperse microcapsules, e.g., lipid vesicles, (approximately 20 μm in diameter) can be exchanged to phosphate buffered saline (PBS) by quick (less than an hour, less than 30 minutes, in some cases less than 15 minutes) depletion of the surrounding oil phase. This process preferably proceeds with limited or no unwanted merging of neighboring microcapsules.

1. Generating Microcapsules in a Microfluidic Device

Figure 2:
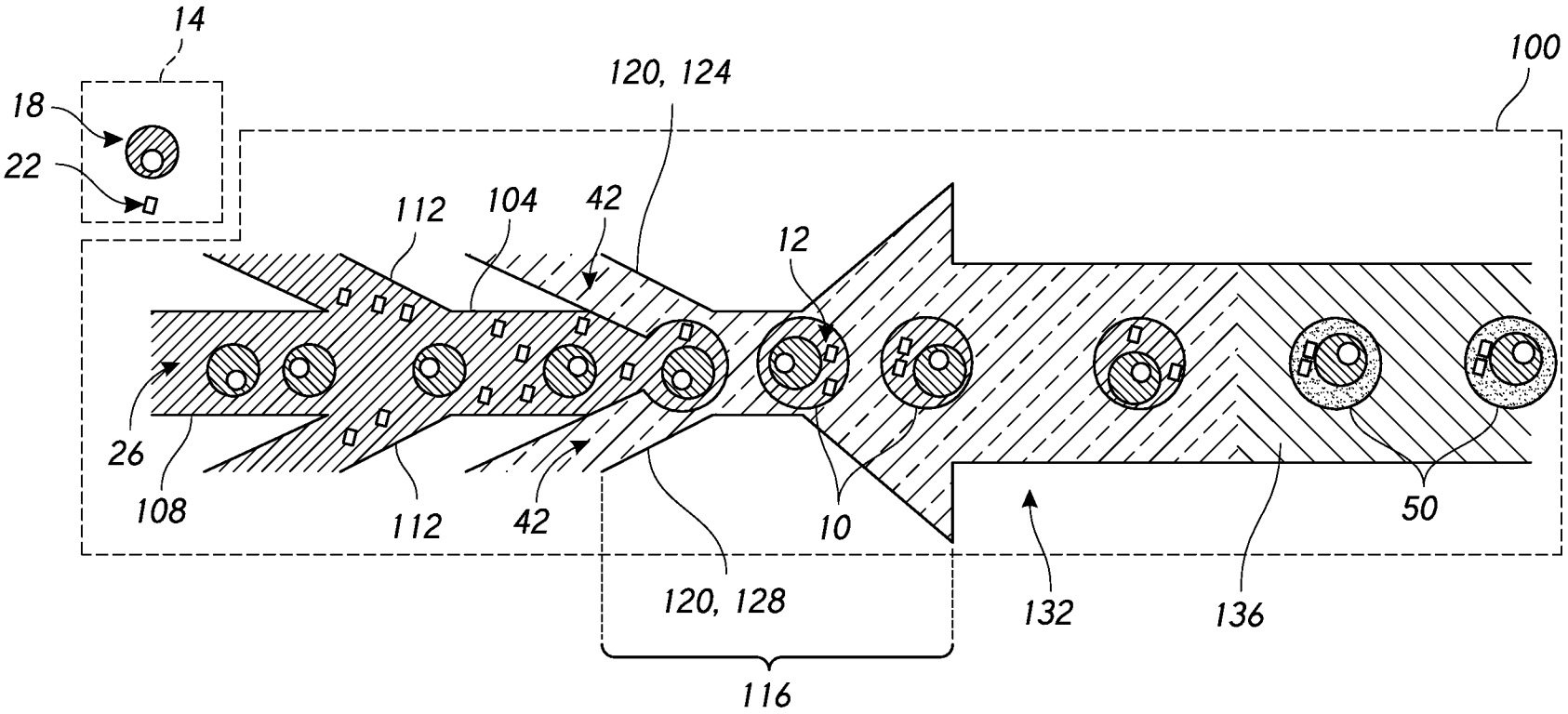
FIG. 2 is a process similar to the process of FIG. 1C in which plant cells and DNA are encapsulated in microcapsules.

FIG. 2 illustrates a process for generating microcapsules 10 in a microfluidic device 100, the microcapsule 10 enclosing a sample 12. The microcapsules optimally include matter 14 to be analyzed. The matter 14 can include solid matter such as cells 18. The matter 14 can include cellular components 22, such as, for example, DNA, RNA, or protein. The cells 18 can be animal cells and/or plant cells. As discussed above, a plant cell can include seeds, cells from seeds, suspension cultures, embryos, meristematic regions, callus tissue, leaves, roots, shoots, gametophytes, sporophytes, pollen, microspores, or protoplasts. The cellular components 22 can include DNA, RNA, polynucleotide, or protein. The cellular components 22 can include plant DNA such as genomic DNA, or mRNA or any fragments thereof. The plant cell can be obtained or derived from corn or maize. The cellular components 22 can be derived from maize or corn. It is desirable to encapsulate a single cell 18, and/or a single or a plurality of cellular components 22. In some implementations it is desired to capture a single cell 18 and/or one or a plurality of cellular components 22. The cells 18 and/or the cellular components 22 can be introduced in suspension with a first fluid 26 into a sample passage or channel 104 of the device 100. The first fluid 26 can be an aqueous medium. As depicted in FIG. 2, the cells 18 can be introduced in an inlet passage 108. The inlet passage 108 can be a first channel of the device 100. The cellular components 22 can be introduced in a fluid supply passage 112. The fluid supply passage 112 can be a second channel of the device. The fluid supply passage 112 can include a plurality of second channels. The first fluid 26 can be introduced in one or all of the passages 108, 112. The passages 108, 112 can flow from a comment inlet of the device 100 to a flow focusing junction 116. The shape of the flow focusing junction 116 is configured to generate droplets stably and at a high rate. Thus, the shape of the flow focusing junction 116 can facilitate stable droplet generation with high throughput. The passages 108, 112 can be in fluid communication with separate inlets of the device 100 to allow for separate controlled introduction of matter into the passages 108, 112. In other implementations, the cells 18 and the cellular components 22 can be introduced through the inlet passage 108. In other implementations, the cells 18 can be introduced through the passage 112 and the cellular components 22 can be introduced through the inlet passage 108.

The device 100 can include a third channel 120 that is configured for flowing a second fluid 42 to the junction 116. The second fluid 42 can be immiscible with the first fluid 26. For example, the second fluid 42 can be an oil. The third channel 120 can provide fluid communication between an inlet to the device 100 and the junction 116. The third channel 120 can be configured to flow a fluid that is immiscible with the fluid 26. The third channel 120 can include a first branch 124 and a second branch 128. The branches 124, 128 can be used as oil phase passages in certain applications. The branches 124, 128 preferably branch out downstream of the inlet of the third channel 120 and extend from the branch point to the junction 116. In some implementations, the branches 124, 128 are separate passages each with their own inlet. The flow of the second fluid 42 in the third channel 120 merges with the suspension of the matter 14 in the first fluid 26 at the junction 116. As the flow in the branches 124, 128 merges, droplets of the first fluid 26 are formed. By controlling the flow rates in the branches 124 and 128, the droplets of the first fluid 26 can be configured to encapsulate a sample 12. The sample 12 can comprise a single cell 18 and/or the cellular components 22. The second fluid 42 can be considered as the continuous phase and the first fluid 26 with the cells 18 and the cellular components 22 can be considered as the dispersed phase. This process produces individual microcapsules 10 within the surrounding volume of the fluid 42. As will be explained further below, one objective is to modify the microcapsules 10 to provide preserved microcapsules 50 that will have enhanced longevity enabling them to be used, tested, and otherwise manipulated for a longer period of time following their formation.

The microcapsules 10 can be transformed into preserved microcapsules 50 in a mixture passage 132. The mixture passage 132 can be a portion of a passages that extends from at or adjacent to the junction 116 and downstream therefrom. The mixture passage 132 can transition into or be in fluid communication with a preservation region 136. The preservation region 136 is a portion of the microfluidic device 100 in which the microcapsules 10 can be preserved, e.g., can be transformed into preserved microcapsules 50. The preservation region 136 can be in communication with a catalyst such as a preservation agent discussed in greater detail below.

2. Trapping Individual Microcapsules for Analysis

Figure 3:
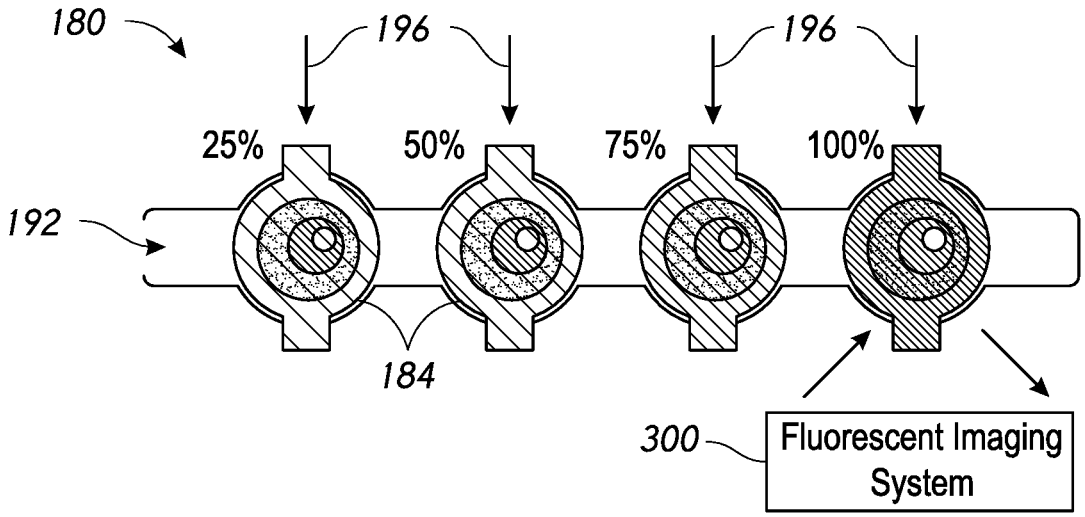
FIG. 3 shows trapping of individual microcapsules in a microwell array for a chemical assay.
Figure 4:
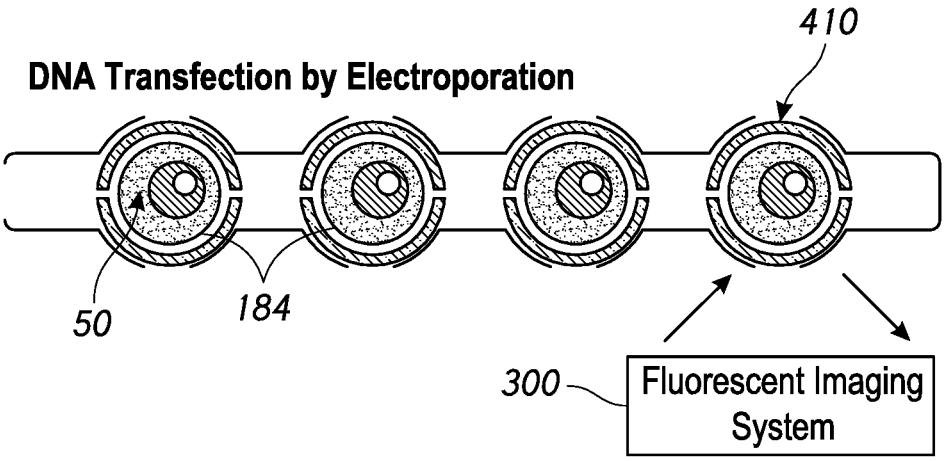
FIG. 4 shows trapping of microcapsules in a microwell array for DNA transfection by electroporation.

FIGS. 3-4 show examples of analyses that can be performed on microcapsules microcapsules 10 or preserved microcapsules 50 that are formed in the microfluidic device 100. The analyses can be performed inside of or outside the microfluidic device 100.

FIG. 3 shows an analysis portion 180 of the microfluidic device 100. The analysis portion 180 can include a microwell array. A microwell array can include a plurality of traps 184 that are configured to retain single microcapsules 10 or single preserved microcapsules 50. The traps 184 can function by allowing a trapping flow 196 that extends transverse to a delivery flow 192 to push individual microcapsules 10 into recesses, wells or micro-wells of the analysis portion 180. The delivery flow 192 can extend along a longitudinal axis of the channel in which the traps 184 are aligned. The trapping flow 196 can extend transverse to the longitudinal axis of the delivery flow 192. The analysis portion 180 can be configured to trap a plurality of microcapsules 10 or preserved microcapsules 50 along the analysis portion 180. Once trapped, the trapping flow 196 can be or can be replaced with a chemical assay component. A chemical assay gradient can be used to expose each of a series of microcapsules 10 or preserved microcapsules 50 to different chemical concentrations to provide the ability to observe the response to chemicals at different concentrations.

For example a chemical in a 25% concentration can flow in the trapping flow 196 across a microcapsule 10 or a preserved microcapsule 50. In some cases in addition to a 25% concentration, another microcapsule 10 or another preserved microcapsule 50 can be exposed to a 50% concentration of a chemical of interest. In some cases in addition to a 25% and a 50% concentration of certain chemicals of interest, a 75% concentrations of a chemical of interest can be exposed to a microcapsule 10 or a preserved microcapsule 50. In some cases in addition to a 25%, a 50% and a 75% concentration of certain chemicals of interest, a 100% concentration of a chemical of interest can be exposed to a microcapsule 10 or a preserved microcapsule 50. The foregoing is one example of an environment concentration gradient. As illustrated in FIG. 3, the analysis portion 180 can be configured such that after the microcapsules 10 or preserved microcapsules 50 are trapped in the array of traps, the trapping flow 196 that flows through each trap of the array of traps in the analysis portion 180 has a different chemical composition and/or a different concentration. One or more of the microcapsules 10 or the preserved microcapsules 50 can be subject to a relevant measurement. In one analysis a fluorescent imaging system 300 can be used to perform a fluorescent imaging ("FLIM") measurement that can be used to study microcapsules 10 or preserved microcapsules 50 in an environmental concentration gradient. The fluorescent imaging system 300 can be configured to receive and detect fluorescence from the preserved microcapsules 50. The fluorescent imaging system 300 can also comprise optical sources configured to excite fluorescence in the preserved microcapsules 50.

In some implementations, the microcapsule 10 or a preserved microcapsule 50 trapped in the microwell array can be exposed to thermocycling. For example, the microcapsule 10 or a preserved microcapsule 50 can be exposed to a temperature higher than room temperature (e.g., 90 degrees Celsius) for a first time interval and room temperature for a second time interval. The temperature can be cycled between room temperature and a temperature higher than room temperature several times. Thermocycling in combination with enzymes can be used replicate DNA via polymerase chain reaction (PCR). Thermocycling can also be useful to sequence DNA of the microcapsule 10 or the preserved microcapsule 50.

FIG. 4 shows another analysis that can be conducted on microcapsules 10 or preserved microcapsules 50. For example, a plurality of microcapsules 10 or preserved microcapsules 50 can be trapped in traps or microwells 184. Thereafter, a DNA analysis can be performed. One example DNA analysis that can be conducted is an analysis involving DNA transfection by electroporation. In one form transfection by electroporation can include exposing a microcapsule 10 or a preserved microcapsule 50 to an electrode 410, which can apply an electrical signal to the microcapsules 10 or the preserved microcapsules 50. Following or during the electrical signal a FLIM measurement can be performed using the fluorescent imaging system 300. In some implementations, cellular components, such as, for example, DNA, RNA or proteins can be extracted from the trapped microcapsules 10 or preserved microcapsules 50 using nanotweezers, atomic force microscope, etc. for further analysis.

Figure 5:
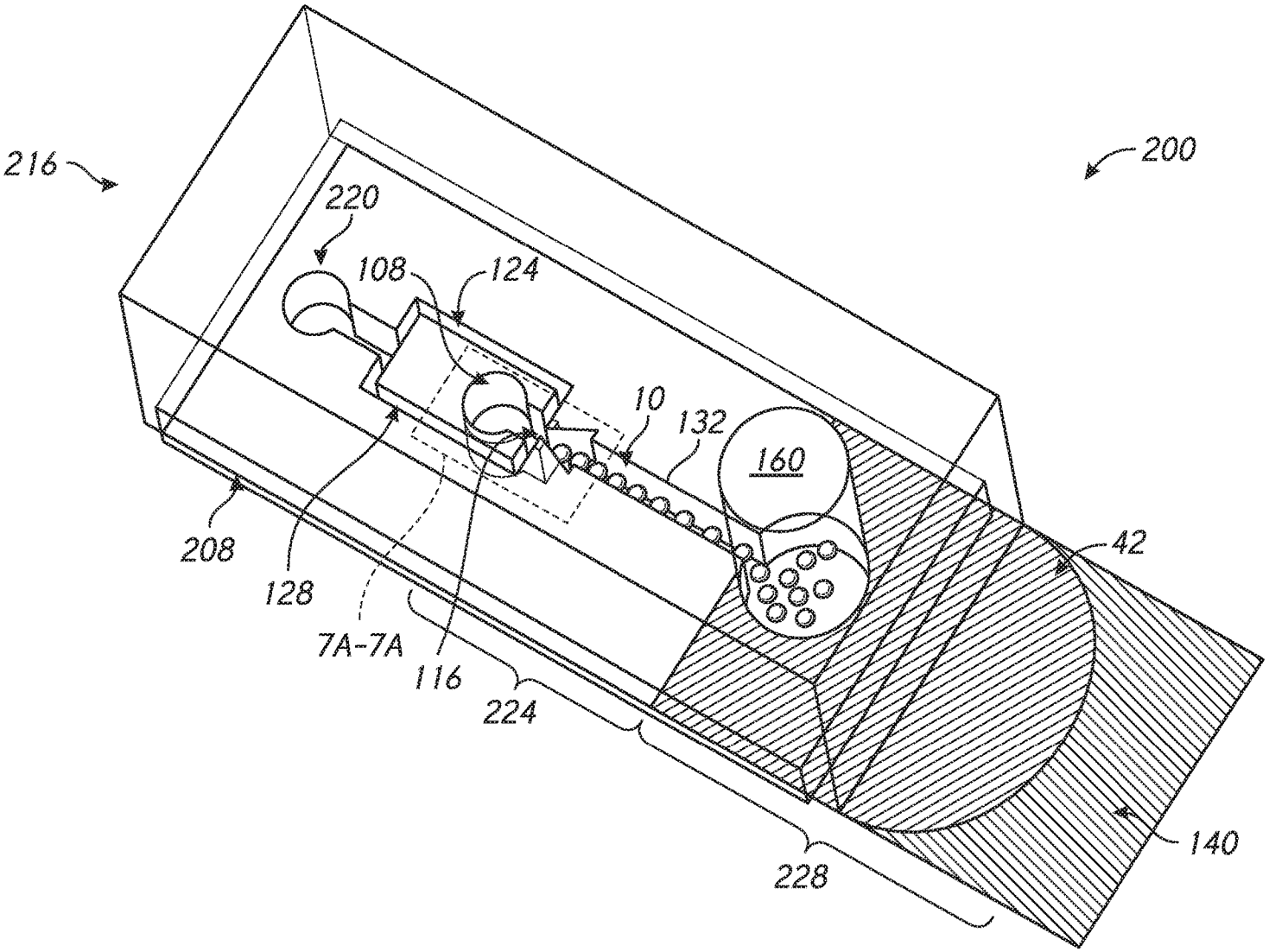
FIG. 5 shows one example of a micro-fluidic device that can be used to generate microcapsules, such as lipid vesicles.

3. Porous Layer Microfluidic Device for Separating Continuous Phase from Microcapsules FIGS. 5-6C show that in several embodiments a microfluidic device can be provided that includes a porous member, such as a porous layer, that enables the continuous phase (e.g., the second fluid 42 discussed above) to be automatically separated, at least in part, from the dispersed phase comprising the microcapsules. FIG. 5 schematically illustrates an embodiment of an integrated microfluidic device 200 an integrated microfluidic device comprising a flow-focusing junction for the generation of monodisperse droplet emulsions, and reservoirs connected to a strip of hydrophobic filter paper for phase exchange and vesicle recovery. The microfluidic device 200 can be used to implement at least some of the process of forming the microcapsules 10 or the preserved microcapsules 50 discussed above with reference to FIG. 2. The microfluidic device 200 is disposed on a substrate 208. The substrate can comprise a polymer (e.g., PDMS) or glass. The device 200 comprises an inlet passage 108 through which an aqueous solution comprising cells 18 and/or cellular components 22 can be introduced into the device 200. The inlet passage 108 is illustrated as well or recess in the microfluidic device 200 but can be volume of the aqueous solution comprising cells 18 and/or cellular components 22 supplied in other ways such as by pumping or under a pressure gradient or capillary forces. In some embodiments, the inlet passage 108 is narrowed or constricted at the inlet passage 108 to regulate the movement of the sample 12 out of the inlet passage 108 and into the junction 116. The aqueous solution comprising cells 18 and/or cellular components 22 flows towards a flow-focusing junction 116. The aqueous solution comprising cells 18 and/or cellular components 22 is referred to herein as the 'aqueous phase,' or the 'dispersed phase'. The inlet passageway 108 can open into the flow-focusing junction 116 through an orifice.

The device 200 further comprises a reservoir 220 through which the second fluid 42 (e.g., oil, mineral oil) can be introduced into the device. The second fluid 42 is referred to herein as the 'oil phase,' or the 'continuous phase'. FIG. 5 shows that a supply of the second fluid 42 introduced into the reservoir 220 can flow downstream therefrom toward the junction 116. As depicted in FIG. 5, the second fluid 42 flows as two separate streams through the two second fluid supply passages 124 and 128 towards the flow focusing junction 116. The two supply passages 124 and 128 branch out from the reservoir 220 such that the second fluid 42 flows in two separate streams toward the junction 116.

As the dispersed phase and the continuous phase merge at the junction 116, droplets of the aqueous solution comprising cells 18 and/or cellular components 22 flow are formed. By controlling the flow rate of the continuous phase in the supply passages 124 and 128, the generated droplets of the aqueous solution can encapsulate the cells 18 and/or the cellular components 22 (e.g., the sample 12). In some implementations, the generated droplets of the aqueous solution can encapsulate a single cell and/or cellular components of the interest. In this manner, the flow-focusing junction 116 can be used to generate monodisperse droplet emulsions, sometimes referred to herein as microcapsules 10. The generated droplets encapsulating the cells 18 and/or the cellular components 22 (e.g., the sample 12) are transported through a mixture passage 132 by the second fluid 42 towards an outlet 160. The region of the microfluidic device 200 thus includes a microcapsule formation region 224 which can extend from the inlet passage 108 to the outlet 160 of the microfluidic device 200.

The microfluidic device 200 further comprises a phase exchange region 228 that comprises the outlet 160. The phase exchange region 228 is configured to separate, at least partially, the continuous phase (e.g., second fluid 42) from the microcapsules 10. One or more reservoirs can be connected to a phase exchange region 228, which can include a strip of hydrophobic filter paper as discussed further below. To facilitate the separation of the microcapsules 10 from the continuous phase (e.g., second fluid 42) the phase exchange region 228 can comprise a porous member 140 at least partially bounding or being in fluid communication with the outlet 160. The porous member 140 can include a strip of hydrophobic filter paper. As discussed further below the porous member 140 can be located on a lower side of the outlet 160 such that mixture flowing out of the mixture passage 132 into the outlet 160 comes to rest on the filter paper. FIG. 5 shows that the filter paper or other porous member 140 extends outwardly of other structure of the microfluidic device 200 such that the oil 42 can flow laterally out of the device. The porous member 140, e.g., filter paper, can be disposed under the outlet 160 and also extend away from the outlet to an exposed position. FIG. 5 shows that the second fluid 42 can even be made visible by the lateral extent of the porous member 140. In other words, the user can visually inspect the microfluidic device 200 to see the oil 42 flowing out of the end into the porous member 140 to assess the progress of the process of preparing the microcapsules 10 or the preserved microcapsules 50. FIG. 5 shows that at the outlet 160, the second fluid 42 forming the continuous phase in the mixture passage 132 diffuses and impregnates through the filter paper rapidly and in some configurations visibly. The microfluidic device 200 illustrates and described a convenient technique to separate, at least partially, the continuous phase (e.g., oil) from the dispersed phase (e.g., droplets comprising a biological matter).

As discussed in further detail below, the various microfluidic passageways of the microfluidic device 200 can be formed on a layer of a polymeric material (e.g., PDMS) using standard microfluidic device fabrication methods. The inlets and outlet can be punched in the layer of polymeric material. The microfluidic device 200 can be bonded (e.g., by plasma bonding) to the porous layer.

The microfluidic device 200 can be used to provide for phase exchange and vesicle recovery. Oil-sheared precursor droplets of DSPC (1,2-distearoyl-sn-glycero-3-phosphocholine) DSPE-PEG2000 (1,2-distearoyl-sn-glycero-3-phosphoethanolamine-N-[amino(polyethylene glycol)-2000]) lipid solutions as the precursor solution can be collected at the outlet 160 using the foregoing device. Any solid matter of interest can be encapsulated in oil-sheared precursor droplets.

Figure 6A:
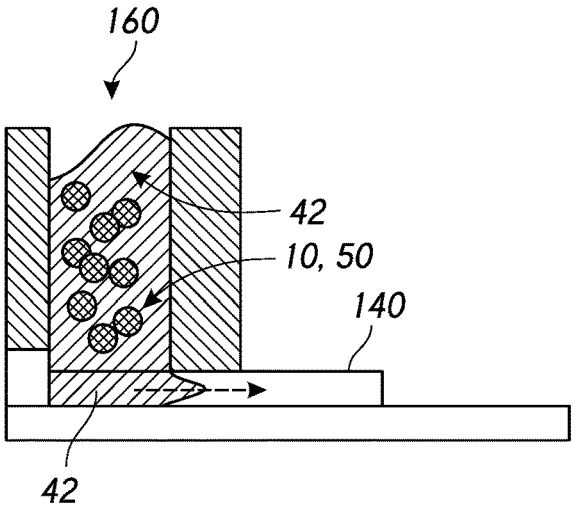
FIG. 6A shows a porous member, e.g., a paper filter, in the process of removing oil surrounding microcapsules to allow the microcapsules to be concentrated in or at the outlet.
Figure 6B:
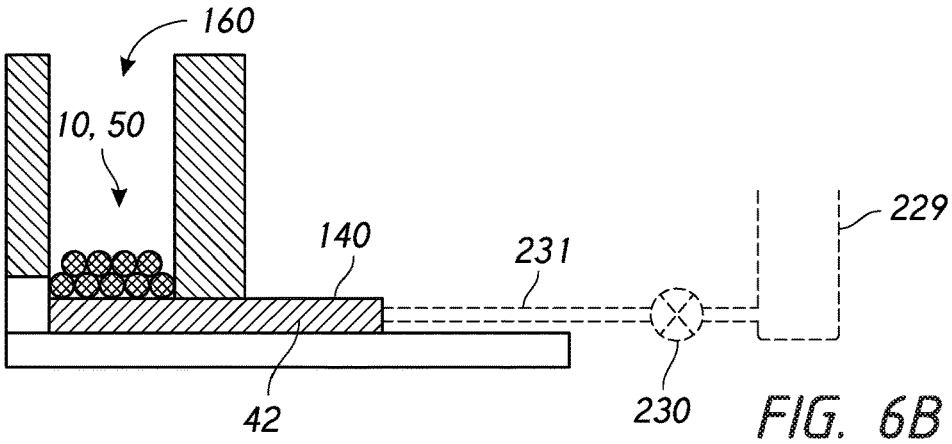
FIG. 6B shows a porous member that has fully separated the oil from surrounding the microcapsules.
Figure 6C:
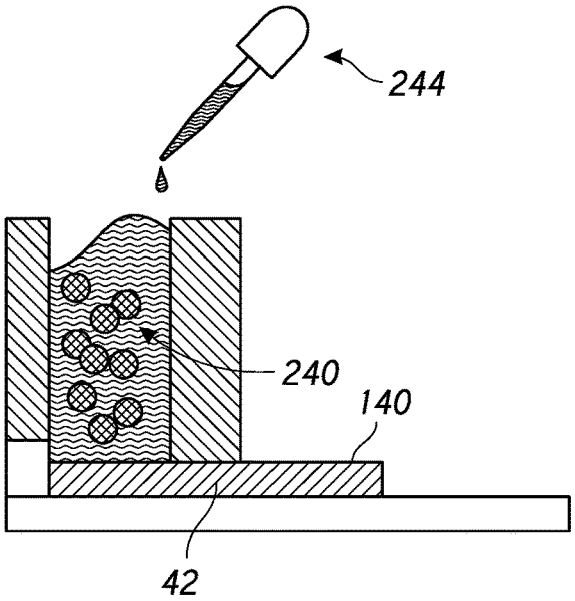
FIG. 6C shows microcapsules that have been separated from the oil suspended in an appropriate buffer fluid.

FIGS. 6A-6C show in more detail how the porous member 140 efficiently and conveniently separates the second fluid 42 or other continuous phase from the microcapsules 10 or the preserved microcapsules 50 or another dispersed phase flowing in the mixture passage 132 to the outlet 160. FIGS. 6A-6C show that at the outlet chamber the surrounding oil phase diffuses and impregnates through the filter paper. After the residual oil penetrated and drained into the paper completely, phosphate buffered saline (PBS) can flow, e.g., can be pipetted, into the collection chamber and the droplet precursors re-suspended in PBS. FIG. 6A shows the output of the mixture passage 132 accumulating in the outlet 160. The mixture initially disposed in the outlet 160 includes the second fluid 42 and the microcapsules 10 or the preserved microcapsules 50 dispersed in the oil 42. The outlet 160 can be partly bounded by impermeable portions, e.g., by portions made of a polymeric material (e.g., PDMS). Because the porous member 140 bounds part of the outlet 160 the oil 42 or other continuous phase begins to seep out of the mixture and into the pores of the porous structure.

FIG. 6A shows that initially the microcapsules 10, 50 can be spread out within the outlet 160 at a first concentration as the second fluid 42 begins to seep out of the outlet 160. In the case of a hydrophobic filter paper, the second fluid 42 is drawn into the pores in the paper and the aqueous matter in the microcapsules 10, 50 is repelled. This enables a substantial portion, e.g., all or substantially all of the second fluid 42 to be drawn into the filter paper (or other porous member 140) while the microcapsules 10, or the preserved microcapsules 50 accumulate in the outlet 160. FIG. 6B shows all of the oil drawn away from the microcapsules 10, or the preserved microcapsules 50. In this state the microcapsules 10, or the preserved microcapsules 50 are disposed on the porous member 140 in a second concentration that is higher than the first concentration.

FIG. 6C shows one example of how the microcapsules 10, or the preserved microcapsules 50 can be extracted from the microfluidic device 200. The microcapsules 10, or the preserved microcapsules 50 can be extracted by flowing a buffer fluid 240 into the outlet 160. The buffer fluid 240 can include PBS in one example. Other examples of buffer fluids can include various liquid buffers including but not limited to cell media, distilled water, lysis buffer, or combinations thereof. The buffer fluid 240 can cause the microcapsules 10, or the preserved microcapsules 50 to be suspended in a third concentration similar to the first concentration. The buffer fluid 240 can be introduced from a buffer source device 244, such as under pressure from a syringe, pipette, microfluidic channel, etc.

In some embodiments, the second fluid 42 may be collected in a container or vessel 229 after the phase exchange region 228 as shown in FIG. 6B. The fluid 42 can be collected from the porous layer 140 or can be collected downstream from the porous layer 140 and directed into the container 229. The container 229 can be selectively placed in fluid communication with the porous layer 140 or with the outlet 160 through a valve 230 and a flow channel 231. The valve 230 can be opened to allow for oil 42 to flow into the channel 231 to the container 229. After collecting the second fluid 42, the fluid 42 may be recycled, or cleaned (e.g., distilled or filtered) then recycled into the reservoir 220, and re-introduced into the device. This method of recycling the fluid 42 can be implemented with embodiment 200 depicted in FIG. 5 and/or embodiment 900 depicted in FIG. 9.

Figure 7A:
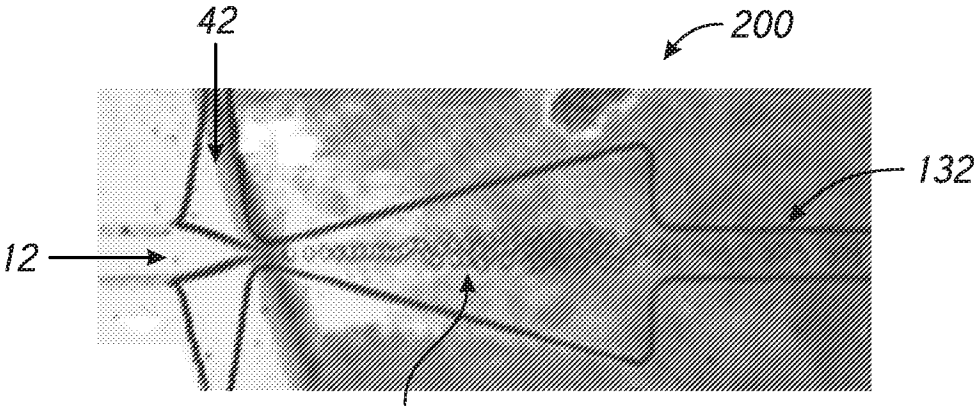
FIG. 7A-7B illustrate aspects of methods of using the microfluidic device of FIG. 5 to generate microcapsules, e.g., lipid vesicles, and to extract the microcapsules from an oil phase to a non-oil (aqueous, buffer) phase.

FIG. 7A is a high magnification bright-field micrograph illustrating the process of lipid droplet generation and the extraction of lipid vesicles from oil phase to aqueous phase using an implementation of the microfluidic device 200. The portion of the microfluidic device 200 illustrated in FIG. 7A is as shown in the dash-line box 7A-7A in FIG. 5. In the illustrated implementation, a lipid is introduced into the flow-focusing junction 116 through the orifice of the inlet passageway 108 and mineral oil is introduced into the flow focusing junction 116 through supply passageways 124 and 128. A portion of the lipid in the inlet passageway 108 can protrude into the flow focusing junction 116. The flow rate of the mineral oil in the passageways 124 and 128 is controlled to shear the protruding lipid finger and form lipid droplets. The generated lipid droplets are conveyed to the output 160 using microfluidics.

There are mainly three kinds of droplet formation regimes: geometry-controlled region, dripping regime and jetting regime. The droplet formation regime is determined by the capillary number $Ca=\mu V/\gamma_{EQ}$, where $\mu$ is the viscosity of the continuous phase, V is the superficial velocity of the continuous phase, and $\gamma_{EQ}$ is the equilibrium surface tension between the continuous and the dispersed phases.

Most traditional flow-focusing devices have been operated in the geometry-controlled regime, termed for the large dependence of droplet size on the smallest feature size in the device (e.g., the orifice). In this regime droplets break off from the dispersed phase finger following a protrude-and-retract mechanism. Droplets in the geometry-controlled regime can be highly monodisperse but limited in minimum size by the width of the orifice.

An increase in the capillary number Ca can lead to droplet generation in the dripping regime. This regime produces monodisperse droplets smaller than the size of the orifice due to narrowing of the dispersed phase finger. The dripping mode can be characterized by a dispersed phase tip that does not retract but rather remains at a fixed location in the orifice, generating a stream of droplets off the tip due to Rayleigh capillary instability.

A further increase in the capillary number leads to droplet generation in the jetting mode, wherein the dispersed phase finger extends far into the flow-focusing junction 116. Droplets, which break off the tip of the dispersed phase finger due again to Rayleigh capillary instability, tend to be as large as or larger than the orifice width in the jetting mode and may be polydisperse.

Depending on the application, the flow rates and the viscosity of the mineral oil can be controlled such that droplets of the lipid are generated in a droplet generation regime (e.g., geometric droplet generation regime) that generates droplets having a size that is sufficiently large to encapsulate a single cell and/or cellular components.

Figure 7B:
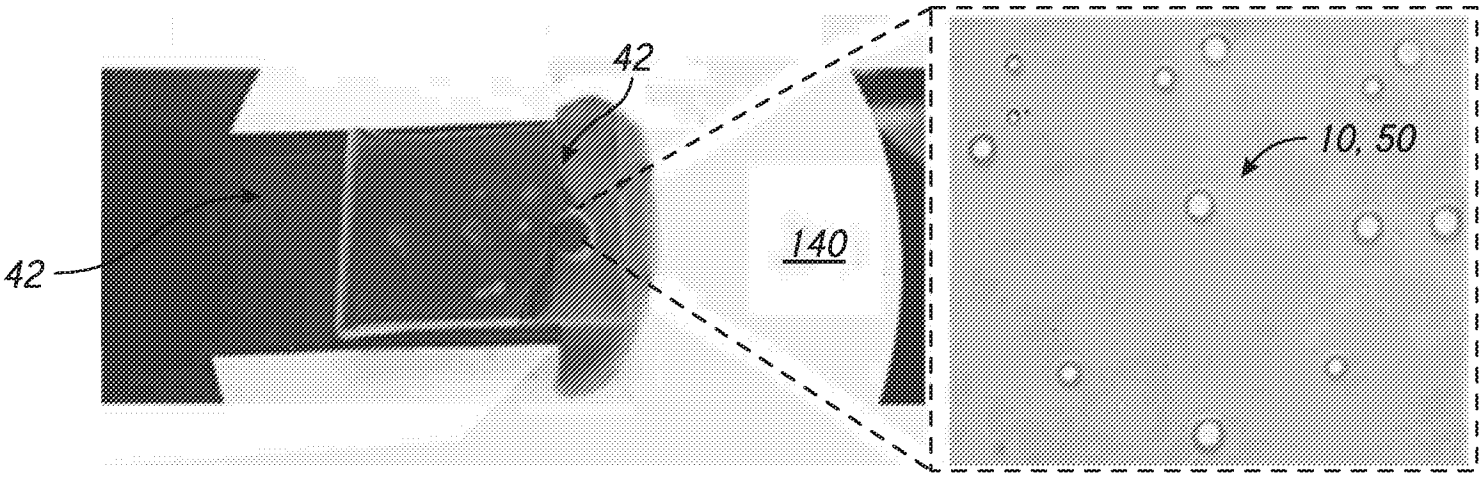

FIG. 7B illustrates the phase exchange portion 228 of the device 200 showing the outlet 160 disposed over a porous layer 140. As observed from FIG. 7B, the second fluid 42 from the outlet 160 seeps onto the porous layer 140 while the lipid vesicles are left in the outlet 160. The time required for the second fluid 42 to penetrate the filter paper was approximately 15 minutes. The diameter of the prepared lipid vesicles was approximately 20 μm. The lipid vesicles did not pass through the filter paper as they had a size larger than the size of the pores of the porous layer 140. About 20 μL buffer solution (e.g., PBS) was placed in the microfluidic outlet and the lipid vesicles were washed and re-suspended in the buffer solution. The inset (dashed box) of FIG. 7B is a bright-field image of liquid-suspended lipid vesicles.

4. Linear Trapping Arrays for Trapping Single Microcapsules

Figure 8:
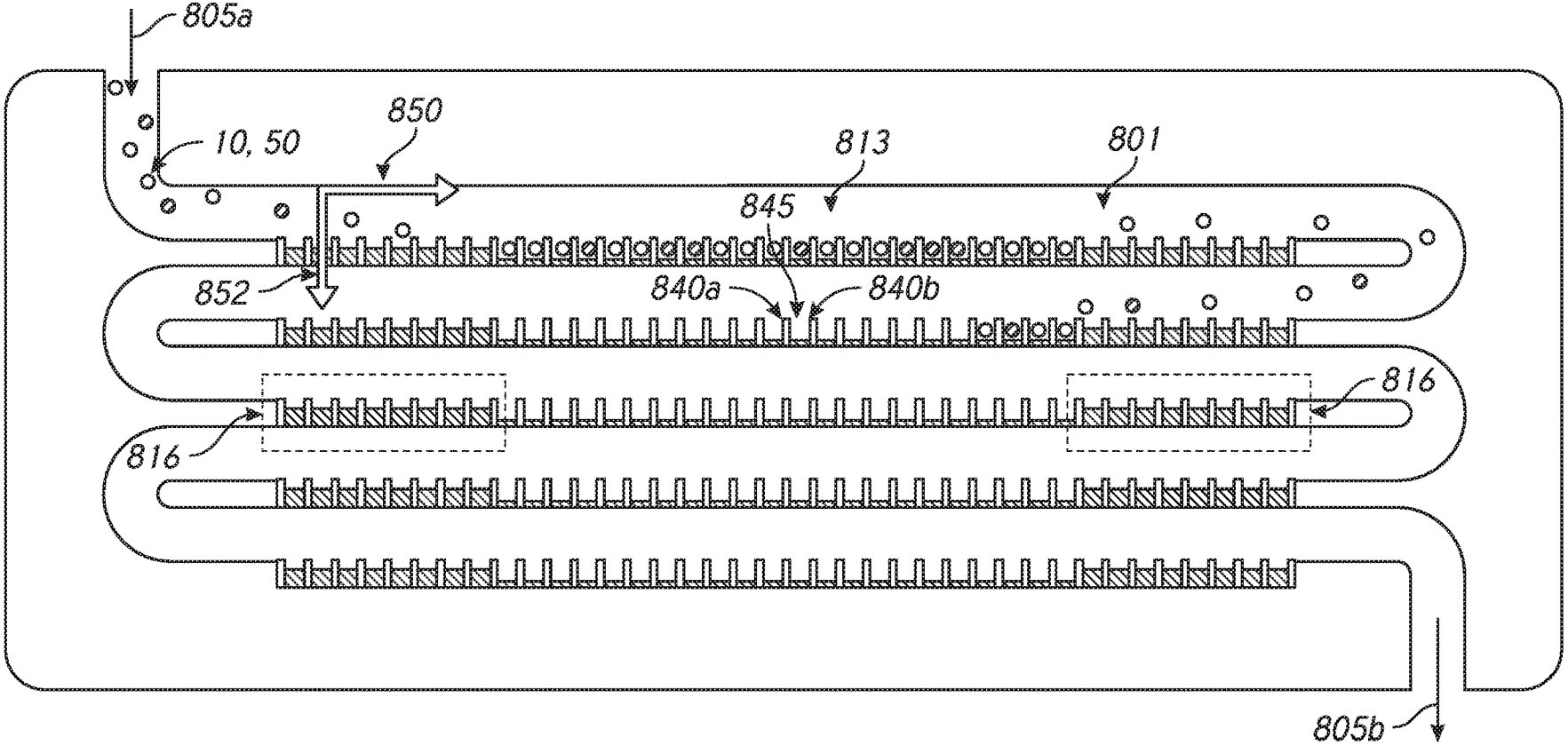
FIG. 8 shows an example of a microwell array that can be used to isolate individual microcapsules.

FIG. 8 illustrates an embodiment of a trapping array 800. The trapping array 800 shown in FIG. 8 comprises a serpentine cell delivery microfluidic channel 801 having an inlet 805*a*, an outlet 805*b* and an array of trapping units 813 disposed along an edge of the channel 801. The serpentine delivery channel 801 includes a plurality of turning zones such that the trapping units of the trapping array 800 are arranged in a plurality of rows. The trapping array 800 includes a plurality of dummy traps 816 disposed at the turning zones of the channel 801. The dummy traps 816 are configured to focus cells towards the trapping units 813. Each trapping unit 813 includes a groove (e.g., a rectangular groove) 845 disposed between two support structures 840*a* and 840*b*. In various embodiments of the trapping unit 813, the groove 845 can include a ledge to receive and trap an individual microcapsule 10 or preserved microcapsule 50. When microcapsules 10 or preserved microcapsules 50 flowing through the serpentine delivery channel 801 are turned by the turning zones, they experience a converging flow and a diverging flow. The flow pattern along the dummy traps of the turning zone 816 focus the microcapsules 10 or the preserved microcapsules 50 towards the trapping units 813.

The microcapsules 10 or preserved microcapsules 50 flowing through the channel 801 in the vicinity of the trapping units 813 experience two flow streams: a delivery flow 850 and a trapping flow 852 perpendicular to the delivery flow 850. The trapping flow 852 is directed along the width of serpentine channel 801 and can cause the microcapsules 10 or preserved microcapsules 50 to cross each row of the delivery channel 801 and be pushed to into various trapping units 813. The dummy traps 816 at the turning zone of each row can help generate perpendicular flow to focus cells towards the traps 813. Accordingly, in the embodiment illustrated in FIG. 8, microcapsules 10 or preserved microcapsules 50 are delivered to the individual trapping units 813 sequentially by the horizontal delivery flow 850, and pushed into the traps by the perpendicular trapping flow 852. The size of an individual trap 813 can be configured to be similar to the size of the microcapsules 10 or preserved microcapsules 50. For example, the size of an individual trap 813 can be approximately about 90 microns to accommodate a single microcapsule 10 or preserved microcapsule 50. Accordingly, when a microcapsule 10 or preserved microcapsule 50 occupies a trap, it physically excludes the next microcapsules 10 or preserved microcapsules 50 from occupying the same trap and thus reduces the possibility of trapping multiple microcapsules 10 or preserved microcapsules 50. In an embodiment of a microfluidic device, in order to trap 100 single cells sequentially, the delivery channel can be configured as a 5-row format, with 20 traps in the middle of each row, and dummy focusing traps in the beginning and end of each row.

The trapping efficiency which is related to the percentage of single microcapsule 10 or preserved microcapsule 50 occupancy can depend on the geometry of the trapping array. For example, the ratio of main channel width to trap size can be modified to vary the trapping efficiency. With every other parameter kept constant, the main channel width (W) can influence resistance ratio between horizontal delivery flow and perpendicular trapping flow. For example, when a width (W) of the main channel is less than a threshold width ($W_{thr}$), the delivery flow may be too strong resulting in empty traps. When a width (W) of the main channel is greater than a threshold width ($W_{thr}$), the delivery flow may not be strong enough compared to the perpendicular flow resulting in multiple microcapsules 10 or preserved microcapsules 50 accumulating at one trapping unit. The threshold width ($W_{thr}$) can be about four times the diameter of the cells to be trapped. In some embodiments, a 4:1 ratio between the main channel width (W) and trap size may be sufficient to achieve high trapping efficiency (e.g., greater than 80%).

Accordingly, the trapping efficiency can be modified by modifying the design parameters of the trapping array 800. Thus, embodiments of a microfluidic device comprising a trapping array designed in accordance with the principles discussed above can be adaptable to a wide range of the input flow rates, and can be easily integrated with other microfluidic components. As all the parameters of this single-cell trapping array can be scaled up and down relative to the target cell diameter, therefore, this single-cell trapping design is adaptable for isolation cells with arbitrary diameters individually.

Figure 9:
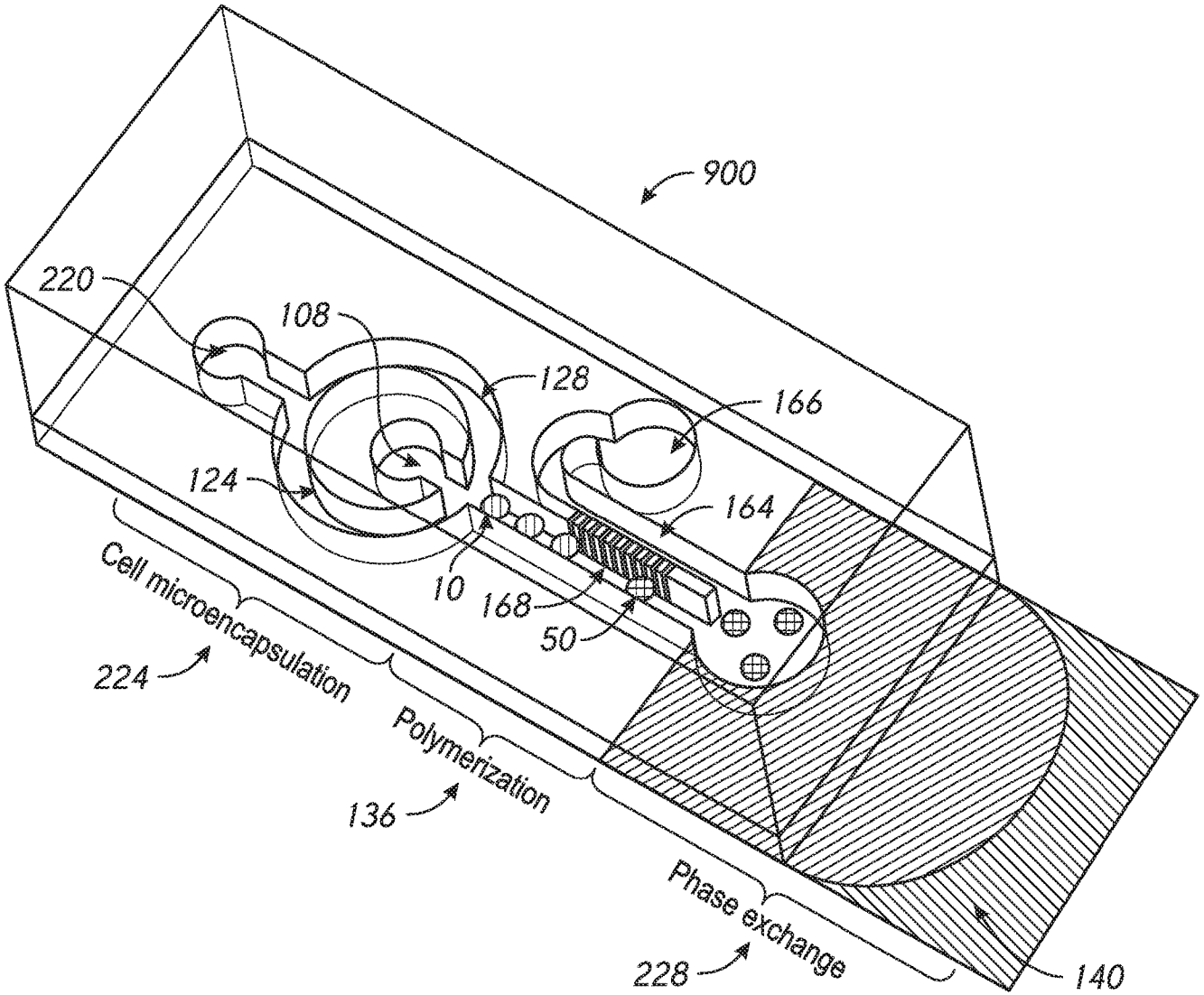
FIG. 9 shows another example of a micro-fluidic device that can be used to generate microcapsules and polymerize the generated microcapsules to preserve the generated microcapsules, e.g., lipid vesicles.

This application contemplates that a well-type output 160 depicted in FIGS. 5 and 9 can be replaced by or implemented as the trapping array 800. Moreover, as discussed above, with reference to FIGS. 3 and 4, after the cells are trapped in the traps 813, the trapping flow 852 can be replaced by one or more chemical agents with different concentrations to perform assays on the trapped cells.

B. Forming Preserved Microcapsules

Figure 10:
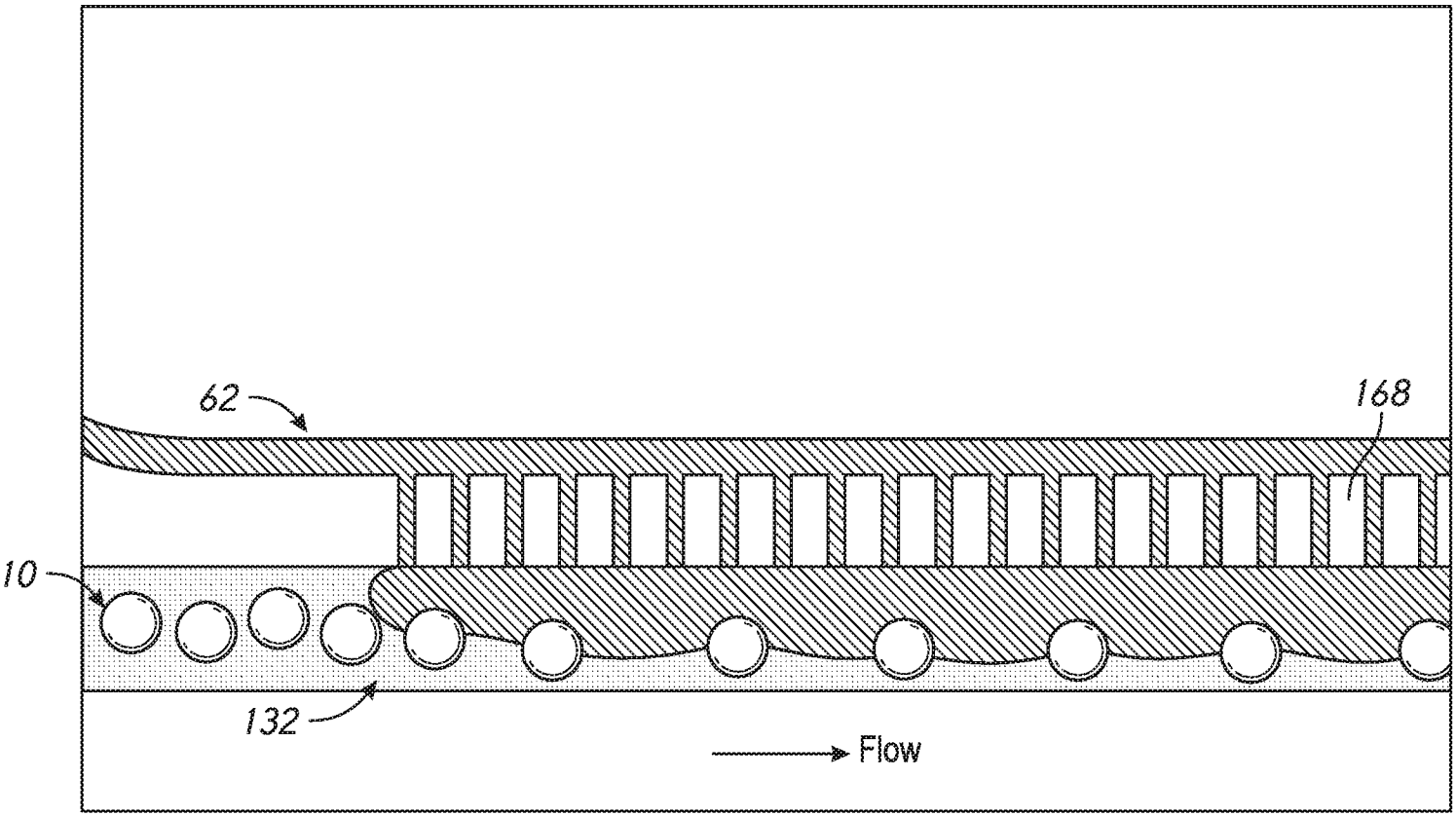
FIG. 10 illustrates bridge structures for merging a preservation agent into a suspension including microcapsules using the microfluidic device of FIG. 9 to generate preserved microcapsules.
Figure 11:
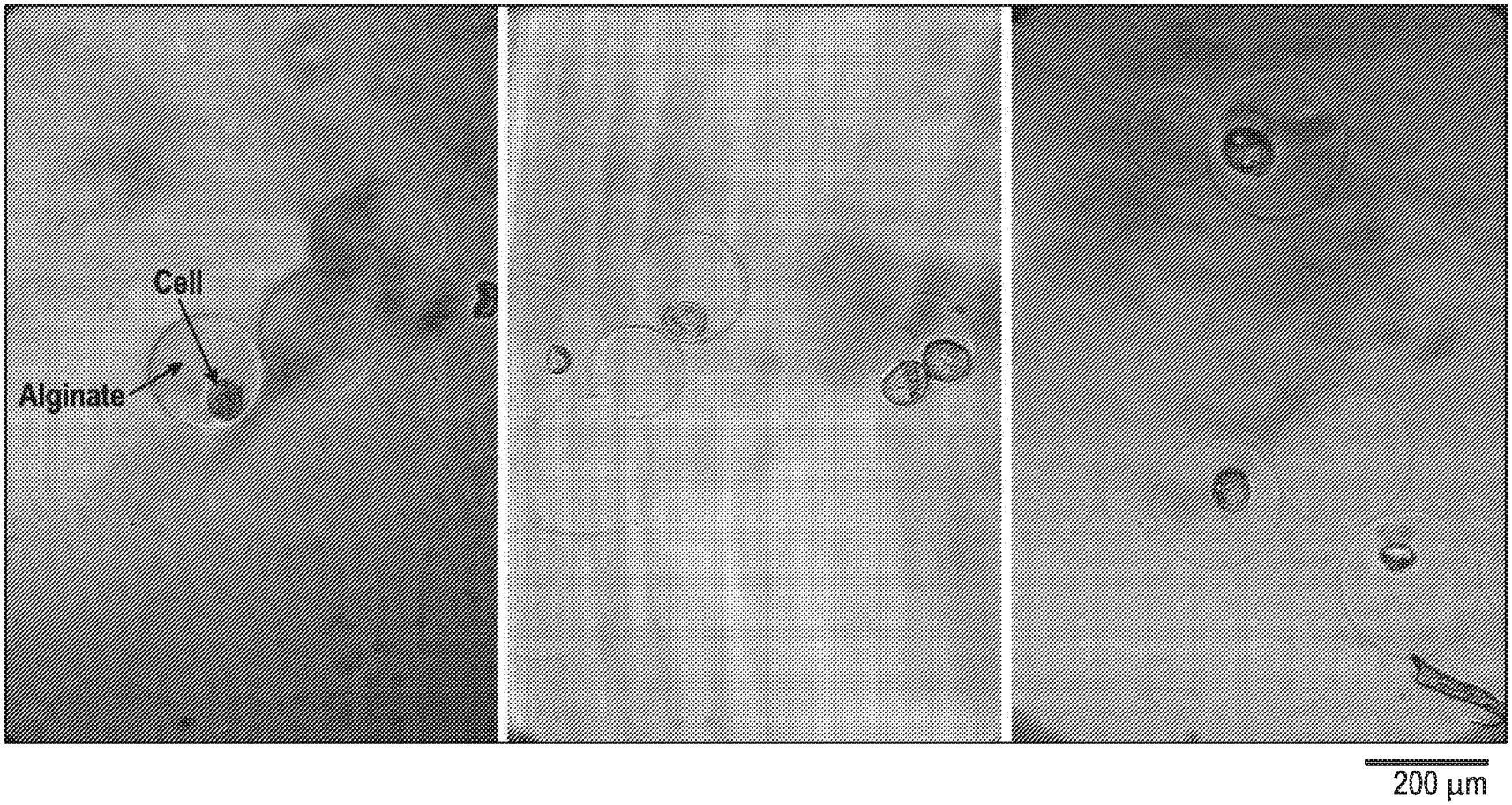
FIG. 11 illustrates aspects of methods of using the microfluidic device of FIG. 9 to extract microcapsules, e.g., lipid vesicles, from an oil phase to a non-oil (aqueous, buffer) phase.

FIGS. 9-11 illustrate various embodiments of apparatuses and methods that facilitate formation of the preserved microcapsules 50. The preserved microcapsules 50 can be provided by forming a biocompatible layer around the sample 12. The biocompatible layer can be formed within a microfluidic device and can result in providing more time for analysis of the solid sample.

The microfluidic device 200 illustrated in FIG. 5 can be modified to include a polymerization region 136 (also referred to above as preservation region) as depicted in FIG. 9. The polymerization region 136 is disposed in the mixture passageway 132 before the outlet 160. A polymerization agent 62 is introduced into the polymerization region 136 to react with the contents of the microcapsules 10 such that a hydrogel is formed around the encapsulated cells 18 and/or the cellular contents 22.

Various structural and functional characteristics of the microfluidic device 900 illustrated in FIG. 9 can be similar to the microfluidic device 200 illustrated in FIG. 5. For example similar to the microfluidic device 200, the device 900 also comprises a microcapsule formation region 224, and a phase exchange region 228. A polymerization region 136 is disposed between the microcapsule formation region 224, and a phase exchange region 228. Microcapsules 10 comprising biological material (e.g., cells 18 and/or cellular contents 22) are formed in the microcapsule formation region 224 as described above. The microcapsules suspended in the continuous phase (e.g., oleic acid) flow into the mixture passageway 132 towards the polymerization region 136. The polymerization region 136 comprises a polymerization agent supply passageway 164 that conveys a polymerization agent 62 (e.g., calcified oleic acid) from a polymerization agent reservoir 166. The polymerization supply passageway 164 is in fluidic communication with the mixture passageway 132 and is configured to mix the polymerization agent 62 with the microcapsules 10 in the mixture passageway 132. The polymerization agent 62 can react with the contents of the microcapsules 10 to form a hydrogel around the encapsulated cells 18 and/or the cellular contents 22. The microcapsules 10 comprising a hydrogel around the encapsulated cells 18 and/or the cellular contents 22 are referred to herein as preserved microcapsules 50. The encapsulated cells 18 and/or the cellular contents 22 can be viable for a few more days in the preserved microcapsules 50 as compared to the un-preserved microcapsules 10. Microcapsules formed by the methods illustrated in FIGS. 1A and 1B can be exposed to the polymerization agent 62 to undergo a polymerization process and form a hydrogel around the encapsulated biologic matter as described above.

In some implementations, the polymerization supply passageway 164 can be disposed parallel to the mixture passageway 132 as shown in FIG. 9. In some such implementations, the polymerization agent 62 can be introduced into the mixture passageway 132 through a micro-bridge 168 that are disposed on a side of the mixture passageway 132 adjacent the polymerization supply passageway 164 and along the length of the mixture passageway 132. The micro-bridge 168 comprises a plurality of micro-structures spaced apart from each other by a gap. The gaps between the structures of the micro-bridge 168 form a plurality of fluidic passageways that interconnect the polymerization supply passageway 164 and the mixture passageway 132. The polymerization agent 62 flows into the mixture passageway 132 through the plurality of interconnecting fluidic passageways. The width of the fluidic passageways can be configured to have a size that is smaller than the size of the microcapsules 10 to prevent the flow of the microcapsules 10 into the polymerization supply passageway 164. The fluid pressure in the polymerization supply passageway 164 can be higher than the fluid pressure of the mixture comprising the microcapsules 10 and the second fluid 42 such that the polymerization agent 62 flows into the mixture passageway 132.

The micro-bridge 168 can advantageously aid in controlling the spacing of the microcapsules 10. By incorporating the micro-bridge 168 interconnecting the mixture passageway 132 and the polymerization supply passageway 164, a fluidic pressure drop can be obtained between the mixture passageway 132 and the polymerization supply passageway 164. The drop in the fluid pressure can control the spacing between adjacent microcapsules 10 flowing through the mixture passageway 132 as illustrated in FIG. 10. The spacing between adjacent microcapsules 10 can be controlled to increase throughput while simultaneously reducing/preventing unwanted aggregation or coalescence of the preserved microcapsules 50. Unwanted coalescence and aggregation of the preserved microcapsules 50 due to insufficient spacing between adjacent microcapsules can reduce both monodispersity and single-cell encapsulation efficiency, despite the presence of a second fluid 42 which can act as a surfactant layer. This application contemplates that less than about 10%-20% of the hydrogel microcapsules may aggregate/coalesce without adversely affecting the through-put.

In one implementation of the microfluidic device 900, the supply passageways 124 and 128 were approximately 200 μm wide and the inlet passageway 108 was approximately 150 μm wide. The mixture passageway 132 had a width of approximately 300 μm. The width of the mixture passageway 132 was expanded to near the outlet 160 to about 330 μm. The polymerization supply passageway 164 had a width of approximately 200 μm. The micro-bridge 168 was about 50 μm wide and about 300 μm long. The gap between adjacent structures of the micro-bridge 168 was configured to prevent the flow of the microcapsules into the polymerization agent supply passageway 164. To test the performance of the above-described implementation of the microfluidic device 900, a suspension of sodium alginate, cells and/or cellular contents in an aqueous medium was introduced in the inlet passageway 108 and oleic acid was introduced in the supply passageways 124 and 128. Sodium alginate is a hydrogel. Other hydrogels such as, for example, polyethyleneglycol diacrylate (PEGDA), agarose, gelatin, Hyaluronic acid can be used in other implementations.

Microcapsules 10 having a size between about 150 μm and about 250 μm were generated in the mixture passageway 132 at a rate of about 600 microcapsules per minute. An average size of the generated microcapsules 10 was about 180 micron. The single-cell encapsulation efficiency of the microcapsules 10 was about 35%. It is noted that various parameters of the microcapsules, such as, for example, size of the microcapsules and/or flow rate of the microcapsules can be controlled by controlling the flow rates of the second fluid 42. Thus, in other implementations the flow rate of the microcapsules can be greater than 600 microcapsules per minute. The single-cell encapsulation efficiency of the microcapsules 10 can also be greater than 35% (e.g., greater than 50%, greater than 60%, greater than 75%, or greater than 90%). As the microcapsules 10 flowed through the mixture passageway 132, a polymerization agent comprising calcified oleic acid was introduced into the mixture passageway 132 to form hydrogel microcapsules 50. The hydrogel microcapsules 50 (also referred to herein as preserved microcapsules 50) were directed to the output 160.

FIG. 10 is a photograph of the polymerization region 136 captured during the testing phase of the above-described implementation of the microfluidic device 900. The photograph depicts flow of microcapsules 10 suspended in the second fluid 42 through a mixture passageway 132 and the flow of the polymerization agent 62 through the interconnecting fluidic passageways formed by the gaps between the micro-structures of the micro-bridge 168. At the beginning of the polymerization region 136, the spacing between the microcapsules 10 is small which can be attributed to a variety of reasons including but not limited to the flow rates of the second fluid 42 and the polymerization agent 62. As microcapsules flow downstream through the polymerization region 136 the polymerization agent 62 reacts with the contents of the microcapsules 10 to form hydrogel microcapsules or preserved microcapsules 50. Due to a reduction in the fluid pressure, the spacing between adjacent hydrogel microcapsules or preserved microcapsules 50 is increased to reduce unwanted aggregation or coalescence of the preserved microcapsules 50. FIG. 11 is a high resolution image illustrating a microcapsule comprising a cell encapsulated within alginate. The image of FIG. 11 can be obtained at the outlet 160 after the second fluid 42 is filtered out using the porous layer 140.

C. Methods of Making Microfluidic Devices for Forming Microcapsules

Figure 12A:
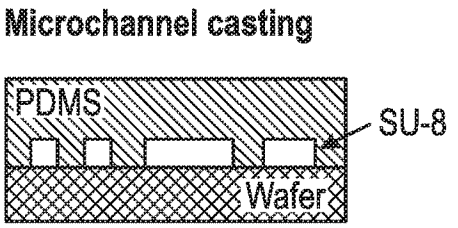
FIGS. 12A-12G show aspects of methods of manufacturing microfluidic devices disclosed herein.

FIGS. 12A-12G discloses a method of manufacturing the microfluidic devices described herein. For example, the method depicted in FIGS. 12A-12G can be used to fabricate the paper-integrated microfluidic devices 200 and 900. The method comprises molding a polymer material (e.g., poly dimethylsiloxane (PDMS)) using a mold as shown in FIG. 12A. The mold can comprise a wafer on which a resist layer (e.g., SU-8 layer) is disposed. The resist layer can be patterned in accordance with the desired microfluidic device design. The resist layer can be patterned using lithography methods.

Figure 12B:
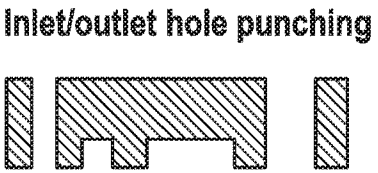
Figure 12C:
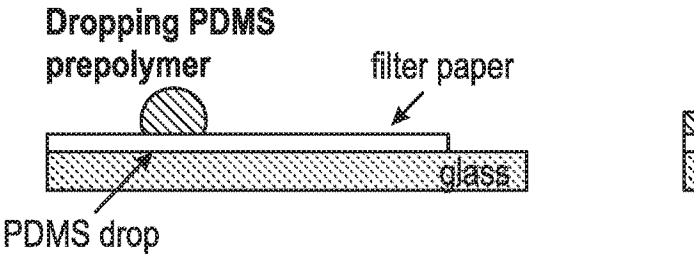
Figure 12D:
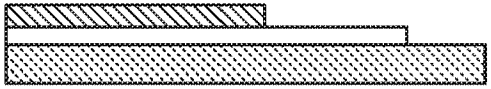
Figure 12E:
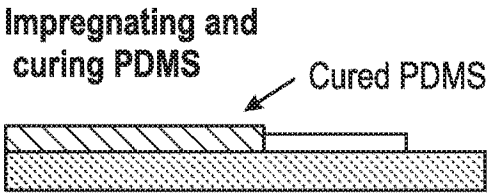
Figure 12F:
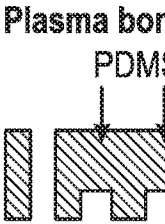
Figure 12G:
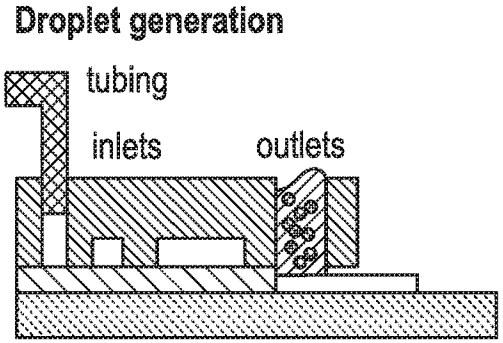

The molded polymer material is separated from the mold as shown in FIG. 12B. Holes can be punched in the molded polymer material to form inlets and outlets thereby forming the microfluidic device. A porous material (e.g., a strip of hydrophobic filter paper) is disposed on a substrate (e.g., glass/glass slide) as shown in FIG. 12C. The porous material can be a hydrophobic filter paper with 0.45 μm pore size available from Millipore Co. in Massachusetts. The porous material can be configured as a bottom impregnation layer of the microfluidic device. A volume of a polymer material (e.g., PDMS pre-polymer) is disposed on the porous material as depicted in FIG. 12C. The volume of polymer material disposed on the porous material can be spread across a surface of the porous material very thinly and partially cured as shown in FIG. 12D. The volume of polymer material disposed on the porous material can be spread across the surface of the porous material using standard manufacturing methods including but not limited to spin coating. The volume of polymer material disposed on the porous material can be impregnated and cured as shown in FIG. 12E to form an impregnating layer. The impregnating layer comprising the cured polymer material disposed on a surface of the porous material is placed at or near the bottom of the microfluidic device. The microfluidic device can be bonded (e.g., plasma bonded by exposure to oxygen plasma for about 30 seconds) to the porous material comprising the polymer material as shown in FIG. 12F and configured for use as shown in FIG. 12G. In some implementations, the microfluidic device can be irreversibly sealed to the impregnating layer.

CONCLUSION

A paper-integrated microfluidic device can be used to prepare monodisperse microcapsules. In one embodiment this process is facilitated by quick oil impregnation through the hydrophobic filter paper.

The integrated device was fabricated by the impregnation of PDMS to the commercially available filter paper.

This integrated process to produce various microfluidic particles from liquid droplets by oil removal or solvent extraction is a simple yet high throughput process to generate a wide range of microcapsules including polymer particles, double emulsions, and lipid vesicles.

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein. Each and every feature described herein, and each and every combination of two or more of such features, is included within the scope of the present invention provided that the features included in such a combination are not mutually inconsistent.

Some embodiments have been described in connection with the accompanying drawings. However, it should be understood that the figures are not drawn to scale. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

For purposes of this disclosure, certain aspects, advantages, and novel features are described herein. It is to be understood that not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Further, the actions of the disclosed processes and methods may be modified in any manner, including by reordering actions and/or inserting additional actions and/or deleting actions. Thus, it is intended that the scope of at least some of the present inventions herein disclosed should not be limited by the particular disclosed embodiments described above. The limitations in the claims are to be interpreted broadly based on the language employed in the claims and not limited to the examples described in the present specification or during the prosecution of the application, which examples are to be construed as non-exclusive.

What is claimed is:

1. An integrated microfluidic system comprising:

a. an impregnating layer comprising a porous material, and a polymer material impregnating a portion of said porous material, herein referred to as an impermeable portion, wherein a non-impregnated portion of the porous material is referred to as a permeable portion; and b. a microfluidic device bonded to the impregnation layer, wherein the microfluidic device comprises:

i. a microencapsulation region disposed on the impermeable portion of the impregnation layer, comprising:

A. a junction;

B. a sample passage for flowing a sample including at least one of a cell or cellular contents into the junction;

C. two oil phase passages for flowing an oil into the junction to form microcapsules enclosing the at least one of the cell or cellular contents; and D. a mixture passage fluid coupled to junction for flowing the microcapsules and oil into an outlet;

ii. a polymerization region disposed on the impermeable portion of the impregnation layer, wherein the polymerization region comprises a polymerization agent supply passage in fluid communication with the mixture passage before the outlet, wherein the polymerization supply passage is configured to convey a calcified polymerization agent into the mixture passage and mix the calcified polymerization agent with the microcapsules in the mixture passageway, wherein the polymerization agent reacts with contents of the microcapsules to form a hydrogel around the encapsulated cells and/or the cellular contents, thereby forming preserved microcapsules; and iii. a phase exchange region comprising:

A. the outlet for collecting a mixture of the preserved microcapsules and oil flowing out of the mixture passage; and B. the permeable portion of the porous material in fluid communication with the outlet, wherein the outlet is partially bounded by the permeable portion such that the mixture flowing out of the mixture passage into the outlet comes to rest on the permeable portion, wherein the permeable portion of the porous material is configured to absorb the oil such that the preserved microcapsules accumulate and become concentrated in the outlet.

2. The system of claim 1, wherein the cell comprises a plant cell.

3. The system of claim 2, wherein the plant cell comprises a microspore, a pollen, or a protoplast.

4. The system of claim 2, wherein the cell comprises a plant cell obtained from a maize or a corn plant.

5. The system of claim 1, wherein the sample comprises a suspension of an alginate and the cell or cellular contents, wherein the calcified polymerization agent comprises calcified oleic acid.

6. The system of claim 1, wherein the polymerization region further comprises a traverse passage, wherein the calcified polymerization agent is flowed from the polymerization agent passage, through the transverse passage, and into the mixture passage.

7. The system of claim 6, wherein the transverse passage comprises a plurality of bridges disposed between and interconnecting the polymerization agent passage and the mixture passage.

8. The system of claim 1, wherein the porous layer comprises a hydrophobic porous layer.

9. The system of claim 8, wherein the hydrophobic porous layer comprises a paper filter.

10. The system of claim 1 further comprising a container in fluid communication with the porous member to enable recycling of the fluid.

11. A method of isolating cells or cellular contents in a microfluidic device, comprising:

a. providing the microfluidic device according to claim 1;

b. flowing a sample including at least one of a cell or cellular contents into the sample passage of the microfluidic device and into the junction;

c. flowing an oil into the junction through the two oil phase passages to form microcapsules enclosing the at least one of the cell or cellular contents, the microcapsules and a volume of the oil forming a microcapsule-oil mixture in the mixture passage;

d. flowing a calcified polymerization agent from the polymerization agent supply passage into the mixture passage to react with the contents of the microcapsule such that a hydrogel is disposed in the microcapsule around the cell or cellular contents thereby forming preserved microcapsules; and e. extracting the preserved microcapsules from the microfluidic device, comprising flowing the microcapsule-oil mixture into the outlet of the microfluidic device, wherein the oil is absorbed into and retained in the permeable portion of the porous layer such that the preserved microcapsules accumulate.

12. The method of claim 11 further comprising flowing a buffer fluid into the outlet to cause the preserved microcapsules to be suspended in the buffer fluid.

13. The method of claim 11 further comprising obtaining the cell or cellular contents from a maize or a corn plant and flowing the cell or cellular contents into the sample passage.

14. The method of claim 11 further comprising collecting the oil from the permeable portion of the porous layer.

15. The method of claim 14, wherein the oil is collected in a container that is in fluid communication with the porous member to enable recycling of the fluid.

16. The method of claim 14 further comprising reintroducing at least a portion of the collected oil into the oil phase passages.

17. The method of claim 11, wherein the cell comprises a plant cell.

18. The method of claim 11, wherein the sample comprises a suspension of an alginate and the cell or cellular contents, wherein the calcified polymerization agent comprises calcified oleic acid.

19. The method of claim 11, wherein the calcified polymerization agent is flowed from the polymerization agent passage, through a transverse passage of the polymerization region, and into the mixture passage disposed between the junction and the outlet.

20. The method of claim 19, wherein the transverse passage comprises a plurality of bridges disposed between and interconnecting the polymerization agent passage and the mixture passage.

* * * * *